US008148299B2

(12) United States Patent
Maruyama et al.

(10) Patent No.: US 8,148,299 B2
(45) Date of Patent: Apr. 3, 2012

(54) REVERSIBLE THERMOSENSITIVE RECORDING MATERIAL, IC CARD, MAGNETIC CARD AND METHOD FOR PRODUCING REVERSIBLE THERMOSENSITIVE RECORDING MATERIAL

(75) Inventors: Jun Maruyama, Yokohama (JP); Satoshi Arai, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 911 days.

(21) Appl. No.: 12/178,256

(22) Filed: Jul. 23, 2008

(65) Prior Publication Data

US 2009/0029854 A1 Jan. 29, 2009

(30) Foreign Application Priority Data

Jul. 24, 2007 (JP) ..... 2007-192153

(51) Int. Cl.
*B41M 5/42* (2006.01)

(52) U.S. Cl. ..... 503/201; 427/150; 427/152; 503/226

(58) Field of Classification Search ..... None
See application file for complete search history.

(56) References Cited

U.S. PATENT DOCUMENTS

| | | | |
|---|---|---|---|
| 5,641,724 | A | 6/1997 | Yamaguchi et al. |
| 5,928,988 | A | 7/1999 | Yamane et al. |

FOREIGN PATENT DOCUMENTS

| | | | |
|---|---|---|---|
| CN | 1148062 | A | 4/1997 |
| CN | 1769068 | A | 5/2006 |
| CN | 1984882 | A | 6/2007 |
| EP | 0832757 | A1 | 4/1998 |
| JP | 6-1066 | | 1/1994 |
| JP | 9-175024 | | 7/1997 |
| JP | 2981558 | | 9/1999 |
| JP | 2000-177244 | | 6/2000 |
| JP | 2001-199164 | | 7/2001 |
| JP | 3501430 | | 12/2003 |
| JP | 3504035 | | 12/2003 |
| JP | 3549131 | | 4/2004 |
| JP | 3596706 | | 9/2004 |
| JP | 2004-314329 | | 11/2004 |
| JP | 2006-68979 | | 3/2006 |
| JP | 2006-82252 | | 3/2006 |
| JP | 2006-88445 | | 4/2006 |
| JP | 2006-88645 | | 4/2006 |
| JP | 2007-52294 | | 3/2007 |
| JP | 2007-55070 | | 3/2007 |

OTHER PUBLICATIONS

European search report in connection with a counterpart European patent application No. 08 16 1010.

Nov. 20, 2009 Chinese official action (with English translation) in connection with a counterpart Chinese patent application No. 200810130012.0.

Nov. 15, 2011 Japanese official action in connection with a counterpart Japanese patent application.

*Primary Examiner* — Bruce H Hess
(74) *Attorney, Agent, or Firm* — Cooper & Dunham LLP

(57) ABSTRACT

A reversible thermosensitive recording material including a support, a reversible thermosensitive recording layer, and a gas barrier layer, the reversible thermosensitive recording layer and gas barrier layer being laid over the support, wherein the reversible thermosensitive recording layer is formed of a reversible thermosensitive composition containing a mixture of an electron-accepting compound and an electron-donating color-forming compound whose color-developed state varies depending upon at least one of a heating temperature and a cooling rate after heating, and wherein the gas barrier layer contains an inorganic layered compound and a gas barrier resin which is at least one selected from the group consisting of polyvinyl alcohol polymers and ethylene-vinyl alcohol copolymers.

19 Claims, 5 Drawing Sheets

REVERSIBLE THERMOSENSITIVE RECORDING MATERIAL, IC CARD, MAGNETIC CARD AND METHOD FOR PRODUCING REVERSIBLE THERMOSENSITIVE RECORDING MATERIAL

BACKGROUND

1. Technical Field

This disclosure relates to a reversible thermosensitive recording material, an IC card, a magnetic card and a method for producing a reversible thermosensitive recording material.

2. Description of the Related Art

Thermosensitive recording materials utilizing color-developing reaction between electron-donating color-forming compounds (hereinafter otherwise referred to as "color formers" or "leuco dyes") and electron-accepting compounds (hereinafter otherwise referred to as "developers") are widely known, and they are widely used as output paper for facsimiles, word processors, scientific measurement devices, etc. along with the development of office automation and also as magnetic cards and IC cards such as commutation tickets for transportation, prepaid cards and discount cards. In particular, these days, note is taken of development of reversible thermosensitive recording materials capable of being rewritten as many times as desired, in view of ecological problems, waste problems and the like.

Reversible color development and color erasure of a reversible thermosensitive recording material will be briefly explained. A typical reversible thermosensitive recording material includes a support, and a thermosensitive recording layer formed on the surface of the support, wherein the support is made of paper, a plastic card, etc. in the form of a film, sheet or plate, and the thermosensitive recording layer is formed of a composition in which the color former and the developer are mixed and dispersed in a thermoplastic resin or the like. The composition containing the color former and the developer in this thermosensitive recording layer does not develop color when the color former and the developer are simply mixed together in a solid form. However, when this composition is made high in temperature, the whole of it comes into a melting state, and the color former and the developer contained react together and develop color. When the composition in this melting state is slowly cooled, the color former and the developer dissociate from each other in the vicinity of the melting temperature thereof, and each of them separately flocculates or crystallizes, thereby erasing the color. Then that state is brought into a frozen state by the solidification of the thermoplastic resin, etc. serving as a binder. However, if the composition in a melting state is rapidly cooled, the composition comes into a frozen state and solidifies before the color former and the developer dissociate from each other. Thus, a color-developed state is maintained, with the color former and the developer bonded together. Selection of a composition which has an appropriate melting temperature and an appropriate freezing temperature and which is formed from a combination of a binder and two types of compounds inducing such a phenomenon makes it possible to select color development and color erasure based upon adjustment of the cooling rate after the composition has been melted by heating, and to keep each of the color-developed state and the colorless state in a frozen state at normal temperature.

FIG. 6 employs a graph to show a change in color development and color erasure of the thermosensitive recording material with respect to a temperature change. In FIG. 6, the horizontal axis denotes time, while the vertical axis denotes temperature. "T1" denotes the melting reaction temperature of the color former and the developer, and "T2" denotes the temperature at which the composition composed of the color former, the developer and the binder solidifies into a frozen state. In other words, in the temperature range between the T1 and the T2, the composition can be flocculated or crystallized, with the color former and the developer dissociated from each other. However, it takes some time for the composition to be flocculated or crystallized through dissociation.

On the graph, the composition originally in a state (a) (color-developed state) at normal temperature is heated to the temperature T1. When the composition has a temperature of T1, it melts within a time $t_1$ and maintains a color-developed state (b) while melting. The composition is slowly cooled, and the temperature thereof is reduced to a temperature T2 with a time $t_2$ being spent, and then returned to normal temperature. When the time $t_2$ is equal to or longer than the time spent by the composition, which has been developing color with reaction, in dissociating into the color former and the developer and flocculating or solidifying, the composition dissociates and comes into a colorless state (c).

When the composition which has lost the color is reheated into a melting state (d), the composition develops the color as the color former and the developer melt and react together. If this composition is rapidly cooled to normal temperature within a short time $t_4$, the composition remains color-developed, as its reacting molecules remain in a frozen state (e).

Further, when the composition in the state (e) is exposed to the dissociation and crystallization temperature range between the melting temperatures T1 and T2 for a long time $t_5$, the color former and the developer dissociate from each other and flocculate or crystallize, thereby possibly erasing the color. In this case as well, when the temperature of the composition is returned to normal temperature, the composition remains in a colorless state (g). By utilizing such a phase change of the composition, it is possible to make the composition develop color and lose color based upon heating and cooling temperatures and rate control. Note that although the space between the T1 and the T2 on the graph is schematically shown and seen large, compositions having approximately several degrees Celsius to 10° C. as this temperature range are applicable in reality.

In Japanese Patent (JP-B) No. 2,981,558, the present inventors proposed a reversible thermosensitive color-developing composition in which an organic phosphoric acid compound having a long-chain aliphatic hydrocarbon group, an aliphatic carboxylic acid compound, or a phenol compound is used as a developer, and a leuco dye serving as a color former is combined therewith; and a reversible thermosensitive recording material using the reversible thermosensitive color-developing composition as a recording layer. This reversible thermosensitive recording material makes it possible to carry out color development and color erasure easily based upon adjustment of heating conditions, sustain the color-developed state and the colorless state stably at normal temperature and repeat color development and color erasure.

In principle, a reversible thermosensitive recording material only requires a thermosensitive recording material layer capable of repeating color development and color erasure as described above. However, as to a reversible thermosensitive recording material disclosed in JP-B No. 2,981,558, a leuco dye used in a reversible thermosensitive recording layer has such a problem that a color-developed portion may fade or a non-color-developed portion (colorless portion) may change in color, thereby impairing the whiteness. The present inventors have found that fading or discoloration of a reversible thermosensitive recording material is related to a tiny amount of oxygen. In particular, many of leuco dyes used as color formers are liable to induce radical reaction with oxygen when activated by light. When a radical reaction is induced, a thermosensitive recording material layer, which has been developing color, may lose the color or may fade; also, a thermosensitive recording material layer, which has been in a colorless state, may develop color, for example, in such a manner as to become yellow.

In each of JP-B Nos. 3,501,430 and 3,504,035, in order to remove such fading of a color-developing portion and discoloration of a non-color-developed portion as described above, the present inventors proposed a reversible thermosensitive recording material in which a thermosensitive recording layer formed of a leuco dye that is relatively resistant to light exposure is covered with a gas barrier layer formed of a polymer resin that has an oxygen-insulating function. Further, in each of JP-B Nos. 3,549,131 and 3,596,706 and JP-A No. 06-1066, the present inventors proposed adding an antioxidant such as α-tocopherol or a vitamin into a gas barrier layer formed of a polymer resin. Such techniques yielded improvements in preventing fading of color-developing images and securing background whiteness. However, as the components are used as a reversible thermosensitive recording material for a long time and repeatedly subjected to heating and cooling for recording and erasure, there are such problems arising that damage to the gas barrier polymer film accumulates, which may cause the gas barrier layer to detach, and thus there may be a degradation of gas barrier function.

In each of JP-A Nos. 09-175024, 2006-82252 and 2006-88445, in an attempt to remove the problem of detachment of a gas barrier layer, there is a proposal to provide between a thermosensitive recording layer and a gas barrier layer an adhesive layer formed of a water-soluble resin or the like, and a proposal to improve the properties of an adherend by adding a specific adhesive into a gas barrier layer, and relatively favorable improvements are yielded.

As discussed supra, reversible thermosensitive recording materials generally have gas barrier layers for oxygen insulation. The gas barrier layers are films formed by synthetic polymer resins having typical gas barrier functions. Among such synthetic polymer resins, polyvinyl alcohol (PVA) resins are characterized in that they are flexible and antistatic and also they are superior in gas barrier property when dry. However, PVA resins have a high affinity for moisture, their gas barrier functions depend largely upon humidity when they are provided as gas barrier films, and thus their gas barrier properties degrade noticeably under high-humidity conditions.

In order to reduce the moisture absorption properties of PVA resins, hydroxyl groups of PVA can be subjected to a chemical modification such as acetalization for water resistance. However, although PVA may be able to be made water resistant by doing so, the hydrogen bonding strength of hydroxyl groups serving as a gas barrier exhibition mechanism of PVA decreases, and thus the original gas barrier properties of PVA are noticeably impaired. Meanwhile, ethylene-vinyl alcohol (EVOH) copolymers, which are materials with gas barrier functions, are superior to PVA in water resistance but inferior to PVA in hydrogen bonding strength, and thus their gas barrier properties cannot be adequately secured under high-humidity conditions.

There has not yet been realized a reversible thermosensitive recording material which does not cause fading of a recorded image or yellowing of a background under high-humidity conditions and in an environment where the material is exposed to fluorescent light or sunlight.

SUMMARY

In an aspect of this disclosure, there is provided a reversible thermosensitive recording material in which neither fading of a recorded image nor change of a background is caused by exposure to light even under high-humidity conditions; and a method for producing the reversible thermosensitive recording material.

Various other aspects or features may be provided, such as, for example, the following.

<1> A reversible thermosensitive recording material including a support, a reversible thermosensitive recording layer, and a gas barrier layer, the reversible thermosensitive recording layer and gas barrier layer being laid over the support, wherein the reversible thermosensitive recording layer is formed of a reversible thermosensitive composition containing a mixture of an electron-accepting compound and an electron-donating color-forming compound whose color-developed state varies depending upon at least one of a heating temperature and a cooling rate after heating, and wherein the gas barrier layer contains an inorganic layered compound and a gas barrier resin which is at least one selected from the group consisting of polyvinyl alcohol polymers and ethylene-vinyl alcohol copolymers.

<2> The reversible thermosensitive recording material according to <1>, wherein the inorganic layered compound is at least one selected from the group consisting of kaolinite minerals, antigorite minerals, smectite minerals, vermiculite minerals and mica minerals.

<3> The reversible thermosensitive recording material according to any one of <1> and <2>, wherein the inorganic layered compound is a synthetic product of a swelling clay mineral.

<4> The reversible thermosensitive recording material according to any one of <1> to <3>, wherein the mass ratio of the gas barrier resin to the inorganic layered compound in the gas barrier layer is in the range of 30:70 to 99:1.

<5> The reversible thermosensitive recording material according to any one of <1> to <4>, wherein the length and the width of the inorganic layered compound are in the range of 5 nm to 5,000 nm each, and the thickness of the inorganic layered compound is 1/10 to 1/10,000 of the length.

<6> The reversible thermosensitive recording material according to any one of <1> to <5>, wherein the inorganic layered compound includes an ion of at least one selected from the group consisting of alkali metals and alkaline earth metals.

<7> The reversible thermosensitive recording material according to any one of <1> to <6>, wherein the ethylene-vinyl alcohol copolymer contains an ethylene component by 20 mol % to 60 mol %, the saponification degree of a vinyl acetate component of the ethylene-vinyl alcohol copolymer is 95 mol % or more, and the ethylene-vinyl alcohol copolymer is insoluble in water.

<8> The reversible thermosensitive recording material according to any one of <1> to <7>, wherein the gas barrier layer further includes an adhesiveness improver for improving its adhesiveness to other layers adjacent thereto.

<9> The reversible thermosensitive recording material according to <8>, wherein the adhesiveness improver contains at least one selected from the group consisting of silane coupling agents, isocyanate compounds, aziridine compounds and carbodiimide compounds.

<10> The reversible thermosensitive recording material according to any one of <1> to <9>, wherein the gas barrier layer is a layer obtained by mixing the inorganic layered compound into a solution of the gas barrier resin and dispersing the inorganic layered compound under a pressure of 1 MPa to 100 MPa to prepare a resin composition, and forming the resin composition into a film and drying the resin composition.

<11> The reversible thermosensitive recording material according to any one of <1> to <10>, wherein the gas barrier layer has a thickness of 0.1 μm to 5.0 μm.

<12> The reversible thermosensitive recording material according to any one of <1> to <11>, further including at least one intermediate layer between the reversible thermosensitive layer and the gas barrier layer so as to improve adhesiveness between the reversible thermosensitive layer and the gas barrier layer.

<13> The reversible thermosensitive recording material according to any one of <1> to <12>, wherein the intermediate layer contains an ester polyol resin.

<14> The reversible thermosensitive recording material according to any one of <1> to <13>, further including at least one undercoat layer between the support and the reversible thermosensitive layer.

<15> An IC card including an IC chip, and the reversible thermosensitive recording material according to any one of <1> to <14>, wherein the IC chip is provided in the support.

<16> A magnetic card including a magnetic recording layer, and the reversible thermosensitive recording material according to any one of <1> to <14>, wherein the magnetic recording layer is provided in the support.

<17> A method for producing a reversible thermosensitive recording material, including forming a reversible thermosensitive recording layer by coating a support with a reversible thermosensitive composition containing a mixture of an electron-accepting compound and an electron-donating color-forming compound whose color-developed state varies depending upon at least one of a heating temperature and a cooling rate after heating; and forming a gas barrier layer by coating the formed reversible thermosensitive recording layer with a gas barrier resin mixed solution containing an inorganic layered compound and a gas barrier resin which is at least one selected from the group consisting of polyvinyl alcohol polymers and ethylene-vinyl alcohol copolymers.

<18> The method for producing a reversible thermosensitive recording material according to <17>, wherein the gas barrier resin mixed solution is prepared by dispersing the inorganic layered compound in a solution containing the gas barrier resin under a pressure of 1 MPa to 100 MPa.

Thus, it is possible to provide a reversible thermosensitive recording material in which neither fading of a recorded image nor change of a background is caused by exposure to light even under high-humidity conditions; and a method for producing the reversible thermosensitive recording material.

DETAILED DESCRIPTION OF THE INVENTION

Figure 1:
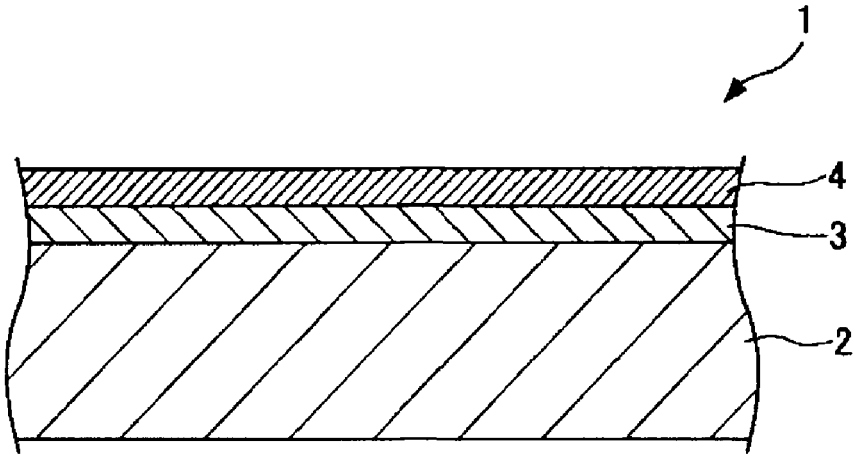
FIG. 1 is a cross-sectional view of a reversible thermosensitive recording material (1) of the present invention.

A reversible thermosensitive recording material of the present invention includes a support, a thermosensitive recording layer and a gas barrier layer, the thermosensitive recording layer and gas barrier layer being laid over the surface of the support, wherein the thermosensitive recording layer contains a color former and a developer, and the gas barrier layer serves to block supply of oxygen to the thermosensitive recording layer. The color former is a leuco dye, which is an electron-donating color-forming compound, and the developer is an electron-accepting compound that makes the leuco dye develop color. As to the thermosensitive recording material in the present invention, color development and color erasure take place reversibly, and the thermosensitive recording material can develop color and erase color according to temperature, for example. Besides the thermosensitive recording layer and the gas barrier layer, it is possible for the reversible thermosensitive recording material of the present invention to include a protective layer which protects the surface of the thermosensitive recording material, an intermediate layer which improves adhesiveness between the thermosensitive recording layer and the gas barrier layer, an undercoat layer which improves adhesiveness and heat-insulating properties between the thermosensitive recording layer and the support, and so forth. Also, a magnetic recording layer, an IC chip, another thermosensitive recording layer, an adhesive layer and the like may be provided on the back surface, inside, etc. of the support. Additionally, the intermediate layer consists of a close contact layer and an anchor coat layer; in the present invention, the close contact layer and/or the anchor coat layer are/is referred to as "intermediate layer".

In principle, a reversible thermosensitive recording material only requires a layer formed of a thermosensitive recording material that is capable of repeating such color development and color erasure as described above. However, a color former and a developer used in the thermosensitive recording layer are easily affected by light; in particular, they are liable to induce a radical reaction with oxygen when activated by light. When a radical reaction is induced, the thermosensitive recording layer, which has been developing color, may lose the color or may fade; also, the thermosensitive recording layer, which has been in a colorless state, may develop color, for example, in such a manner as to become yellow. The gas barrier layer is for preventing oxygen in the air from entering into the thermosensitive recording layer. Additionally, since a support is generally a thick sheet or the like, it has an adequate oxygen-insulating function. When the support does not have an oxygen-insulating function, the support side may also be covered with the gas barrier layer.

The following explains the gas barrier layer, the close contact layer, the anchor coat layer, the thermosensitive recording layer, the support, the undercoat layer and the protective layer in the reversible thermosensitive recording material of the present invention.

[Gas Barrier Layer]

The gas barrier layer in the present invention contains a gas barrier resin and an inorganic layered compound. The gas barrier layer covers the thermosensitive recording layer, thereby performing a function of preventing fading or discoloration of the thermosensitive recording layer caused by oxygen entering into the thermosensitive recording layer and reacting with the color former and the developer. In particular, as the period of time for which the reversible thermosensitive recording material is used lengthens, it is necessary to further improve the gas barrier properties of the gas barrier layer. Due to the prevention of oxygen from entering into the thermosensitive recording layer, the reversible thermosensitive recording material (1) becomes superior in light resistance and does not fade or discolor for a long time.

For the gas barrier resin, a resin having a great transmittance with respect to light in the visible region is suitable. It is advisable to select the gas barrier resin according to the use thereof, oxygen permeability, transparency, mixing properties with the inorganic layered compound, adhesiveness to the thermosensitive recording layer, moisture resistance, coating capability, etc.

Although it varies according to the oxygen permeability of the gas barrier layer, the thickness of the gas barrier layer is preferably in the range of 0.1 μm to 20 μm, more preferably in the range of 0.3 μm to 10 μm. When the thickness is so small as to be outside this range, it is not favorable because the gas barrier layer often has imperfect oxygen barrier properties and moisture barrier properties. When the thickness is so large as to be outside this range, it is not favorable because the sensitivity of the recording layer to a heating head or the like degrades as a thermosensitive recording material.

(Gas Barrier Resin)

Among gas barrier resins applicable to the present invention, polyvinyl alcohol, derivatives thereof and modified products thereof are all acceptable as polyvinyl alcohol polymers, and each of these may be used alone or in combination with two or more. It is desirable that the polyvinyl alcohol polymers each have a polymerization degree of 100 to 5,000, more desirably 500 to 3,000, and a saponification degree of 60 mol % or more, more desirably 75 mol % or more. Examples of the derivatives of polyvinyl alcohol include a polyvinyl alcohol derivative in which hydroxyl groups are acetalized by up to approximately 40 mol %, and examples of the modified products of polyvinyl alcohol include a polyvinyl alcohol modified product obtained by copolymerizing a carboxyl group-containing monomer and an amino group-containing monomer.

Polyvinyl alcohol polymers are advantageous in that they have very high gas barrier properties when dry; however, at high humidity, the extent to which their gas barrier properties degrade is larger than the extent to which those of ethylene-vinyl alcohol copolymers degrade. Therefore, in the case where a polyvinyl alcohol polymer is used at high humidity, it is desirable that the after-mentioned inorganic layered compound be contained in large amounts when a gas barrier is formed.

As an ethylene-vinyl alcohol copolymer used for the gas barrier resin, an ethylene-vinyl alcohol copolymer obtained by saponifying an ethylene-vinyl acetate copolymer can be employed. Specific examples of the gas barrier resin obtained by saponifying an ethylene-vinyl acetate copolymer include a substance obtained by saponifying an ethylene-vinyl acetate copolymer produced by copolymerizing ethylene and vinyl acetate, and a substance obtained by saponifying an ethylene-vinyl acetate copolymer produced by copolymerizing ethylene, vinyl acetate and other monomer(s). As for the material to form the gas barrier layer, it is desirable that ethylene occupy 20 mol % to 60 mol % of all monomer components in the ethylene-vinyl acetate copolymer before copolymerization. When ethylene occupies less than 20 mol % of all monomer components, the gas barrier properties of the gas barrier layer degrade at high humidity. When ethylene occupies more than 60 mol % of all monomer components, the gas barrier properties thereof tend to degrade.

As to the ethylene-vinyl acetate copolymer, the saponification degree of the vinyl acetate component is preferably 95 mol % or more. When the saponification degree is less than 95 mol %, the gas barrier properties and oil resistance of the gas barrier layer tend to be inadequate. Also as to the ethylene-vinyl acetate copolymer, one which has been reduced in molecular weight by being treated with a peroxide or the like is further desirable in that its dissolution stability in a solvent improves.

(Inorganic Layered Compound)

The inorganic layered compound is not particularly limited as long as it is a layered compound that is inorganic; however, an inorganic layered compound which swells and is cleaved in a dispersion medium is preferable, and examples thereof include kaolinite-group minerals, antigorite-group minerals, smectite-group minerals, vermiculite-group minerals and mica-group minerals. Specific examples thereof include kaolinite-group minerals having a 1:1 phyllosilicate structure, antigorite-group minerals belonging to the serpentine group, smectite-group minerals accepted depending upon the number of interlayer cations, vermiculite-group minerals that are water-containing silicate minerals, and mica-group minerals. More specific examples thereof include kaolinite, nacrite, dickite, halloysite, hydrated halloysite, antigorite, chrysotile, pyrophyllite, montmorillonite, beidellite, saponite, hectorite, sauconite, stevensite, tetrasilicic mica, sodium taniolite, muscovite, margarite, talc, vermiculite, phologopite, xanthophyllite and chlorite. These may be natural products or synthetic products of swelling clay minerals. In addition, scale-like silica and the like may also be used. Each of these may be used alone or in combination with two or more. Among these minerals, montmorillonite and mica are preferable in view of gas barrier properties when used as gas barrier layers.

In the case where the inorganic layered compound is a natural product, the inorganic layered compound is relatively large in size after dispersed in the gas barrier resin, and thus its gas barrier function can be easily secured; however, inorganic metal ions contained in tiny amounts as impurities may cause an oxidation degradation of the gas barrier layer, etc. due to application of thermal energy when an image is formed on the recording material of the present invention, thereby possibly forming a colored component. As to this phenomenon, when an originally formed image on the recording material of the present invention is erased, the colored component is viewed as an unerased portion, and thus the image quality is noticeably impaired. To remove this trouble, it is desirable to avoid the oxidation degradation, caused by impurity inorganic metal ions, by adding an alkali metal or an alkaline earth metal when the inorganic layered compound, which is a natural product, and the gas barrier resin are mixed together.

In the case where the inorganic layered compound is a synthetic product of a swelling clay mineral, since the above-mentioned impurities are scarcely mixed therein, there is little trouble caused in terms of image quality; however, when the inorganic layered compound is synthesized, there is a decrease in particle diameter, and thus a decrease in gas passageway length, so that desired gas barrier properties may not be able to be exhibited. In the present invention, both an inorganic layered compound derived from a natural product and an inorganic layered compound derived from a synthetic product may be used; it should be noted that suitable gas barrier properties are obtained by defining the mixture ratio of the gas barrier resin to the inorganic layered compound while accurately grasping the properties of the substance used. Examples of the synthetic product include synthetic mica, physically treated mica and chemically treated mica.

In the gas barrier layer, the mass ratio of the gas barrier resin to the inorganic layered compound is in the range of 30:70 to 99:1, preferably in the range of 30:70 to 50:50. When the inorganic layered compound occupies a smaller proportion, adequate gas barrier properties cannot be obtained. When it occupies a larger proportion, there is a deficiency of coating strength and adhesiveness to other layers, and there is a degradation of transparency, which is not favorable as a thermosensitive recording material.

By dispersing the inorganic layered compound in the gas barrier layer, it is possible to improve the moisture-insulating properties of the gas barrier layer, besides the oxygen-insulating properties thereof. It should be particularly noted that although gas barrier resins having superior oxygen-insulating properties, such as polyvinyl alcohol, absorb moisture and do not have adequate oxygen-insulating properties in high-humidity environments, the gas barrier layer can exhibit superior oxygen-insulating properties in high-humidity environments as well as in low-humidity environments by adding the inorganic layered compound into any of such gas barrier resins. Further, it is also possible to prevent degradation caused as the gas barrier resin absorbs moisture and to prevent the gas barrier layer and the thermosensitive recording layer from detaching from each other.

It is desirable that the inorganic layered compound be shaped like a plate whose length and width are in the range of 5 nm to 5,000 nm each, notably in the range of 10 nm to 3,000 nm each, and whose thickness is approximately $1/10$ to $1/10{,}000$, preferably approximately $1/50$ to $1/5{,}000$, of the length. When the inorganic layered compound is too large in size, uneven mixture is liable to arise in the gas barrier layer, which makes it difficult for uniform mixture to take place, and thus it is difficult for a thin film to be formed. When the inorganic layered compound is too small in size or its thickness is too large in relation to its length and width, it is difficult for the inorganic layered compound to disperse in the gas barrier layer because the inorganic layered compound aligns parallel to the gas barrier layer, and thus there is a degradation of gas barrier property.

(Adhesiveness Improver)

Since the gas barrier layer contains the inorganic layered compound, it is desirable that it also contain an adhesiveness improver for improving its adhesiveness to adjacent layers. In order for the gas barrier layer to be able to withstand formation and removal of a recorded image that takes place many times, in other words a repetition of heating and cooling, which is a fundamental feature of the recording material of the present invention, it is desirable that at least one type of adhesiveness improver for improving adhesiveness to adjacent layers, such as a silane coupling agent, a titanium coupling agent, an isocyanate compound, an aziridine compound, etc., be added into the gas barrier layer in accordance with the necessity.

Examples of the silane coupling agent used in the present invention include vinyl group-containing alkoxysilanes such as vinyltrimethoxysilane, vinyltriethoxysilane, N-β-(N-vinylbenzylaminoethyl)-γ-aminopropyltrimethoxysilane, vinyltriacetoxysilane and 3-propyltrimethoxysilane methacrylate; epoxy group-containing alkoxysilanes such as 3-glycidoxypropyltrimethoxysilane, 3-glycidoxypropylmethyldimethoxysilane and 2-(3,4-epoxycyclohexyl)ethyltrimethoxysilane; amino group and/or imino group-containing alkoxysilanes such as 3-aminopropyltriethoxysilane, 3-N-(2-aminoethyl)aminopropyltrimethoxysilane and 3-N-(2-aminoethyl)aminopropylmethyldimethoxysilane; isocyanate alkoxysilanes such as triethoxysilylpropylisocyanate; mercapto group-containing alkoxysilanes such as γ-mercaptopropyltrimethoxysilane; and ureido group-containing alkoxysilanes such as γ-ureidopropyltriethoxysilane. Among these compounds shown as specific examples, amino group-containing trialkoxysilane compounds and mercapto group-containing trialkoxysilane compounds are preferable because reaction with organic residues adjacent to the gas barrier layer proceeds quickly and also because the fact that an alkyl group contained in a trialkoxysilyl group is a methyl group enables reaction with the inorganic layered compound in the gas barrier layer to proceed quickly.

Examples of the aziridine compound used in the present invention include trimethylolpropanetris(3-aziridinylpropionate), trimethylolpropanetris[3-(2-methyl-aziridinyl)-propionate], trimethylolpropanetris(2-aziridinyl butyrate), tris(1-aziridinyl)phosphine oxide, pentaerythritoltris-3-(1-aziridinylpropionate), pentaerythritol tetrakis-3-(1-aziridinylpropionate) and 1,6-bis(1-aziridinocarbamoyl) hexamethylenediamine.

Examples of the isocyanate compound used in the present invention include the following compounds: aliphatic and alicyclic diisocyanates such as hydrogenated TDI, hydrogenated XDI, hydrogenated MDI, hexamethylene diisocyanate (HDI), isophorone diisocyanate (IPDI) and xylylene diisocyanate (XDI); trifunctional or higher polyisocyanates of burette type, isocyanurate type, adduct type, etc., which are derivatives of aliphatic and alicyclic diisocyanates; aliphatic isocyanate compounds such as isocyanate-containing oligomers and isocyanate-containing polymers; aromatic diisocyanates such as phenylene diisocyanate (PDI), toluene diisocyanate (TDI), naphthalene diisocyanate (NDI) and 4,4'-diisocyanate diphenylmethane (MDI); trifunctional or higher polyisocyanates of burette type, isocyanurate type, adduct type, etc., which are derivatives of aromatic diisocyanates; and aromatic isocyanate compounds such as isocyanate-containing oligomers and isocyanate-containing polymers. As to the formation of the gas barrier layer, since a gas barrier coating composition basically contains water as a solvent owing to the fact that it is used together with a water-soluble polymer, it is desirable to allow the gas barrier layer to harden progressively after the formation thereof, by restraining reaction with the water. Accordingly, self-emulsifying polyisocyanate compounds to exist dispersed in water, which are produced by introducing hydrophilic groups into skeletons of isocyanate compounds, are further desirable. Also, introduction of hydrophobic groups is even more desirable in that reaction with the water can be further restrained before the formation of the gas barrier layer.

A carbodiimide compound used in the present invention is preferably of a water-dispersible emulsifying type as in the above-mentioned case. In modification of the carbodiimide compound for hydrophilicity, a substance in which a chain has been elongated by a urethanization reaction between an isocyanato-terminal carbodiimide compound and a polyol compound, and further, a molecular end has been modified for hydrophilicity with a hydrophilic oligomer is favorable in terms of the balance between stability and cross-linking ability and can therefore be suitably used in the present invention.

(Method for Forming Gas Barrier Layer)

Figure 5:
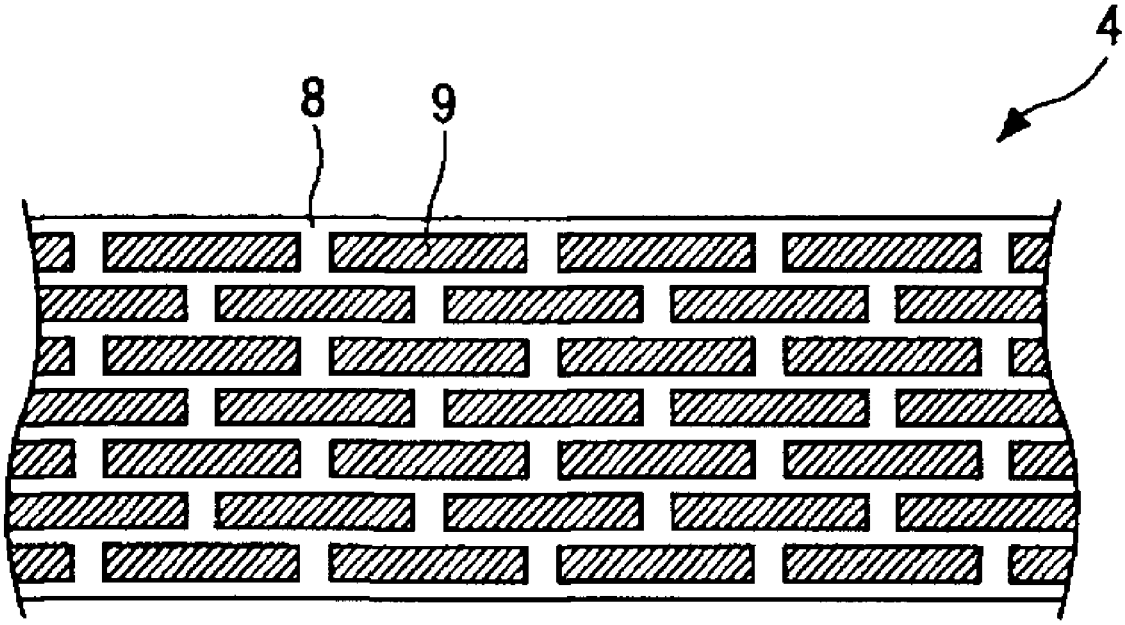
FIG. 5 is a cross-sectional view of a gas barrier layer.
Figure 6:
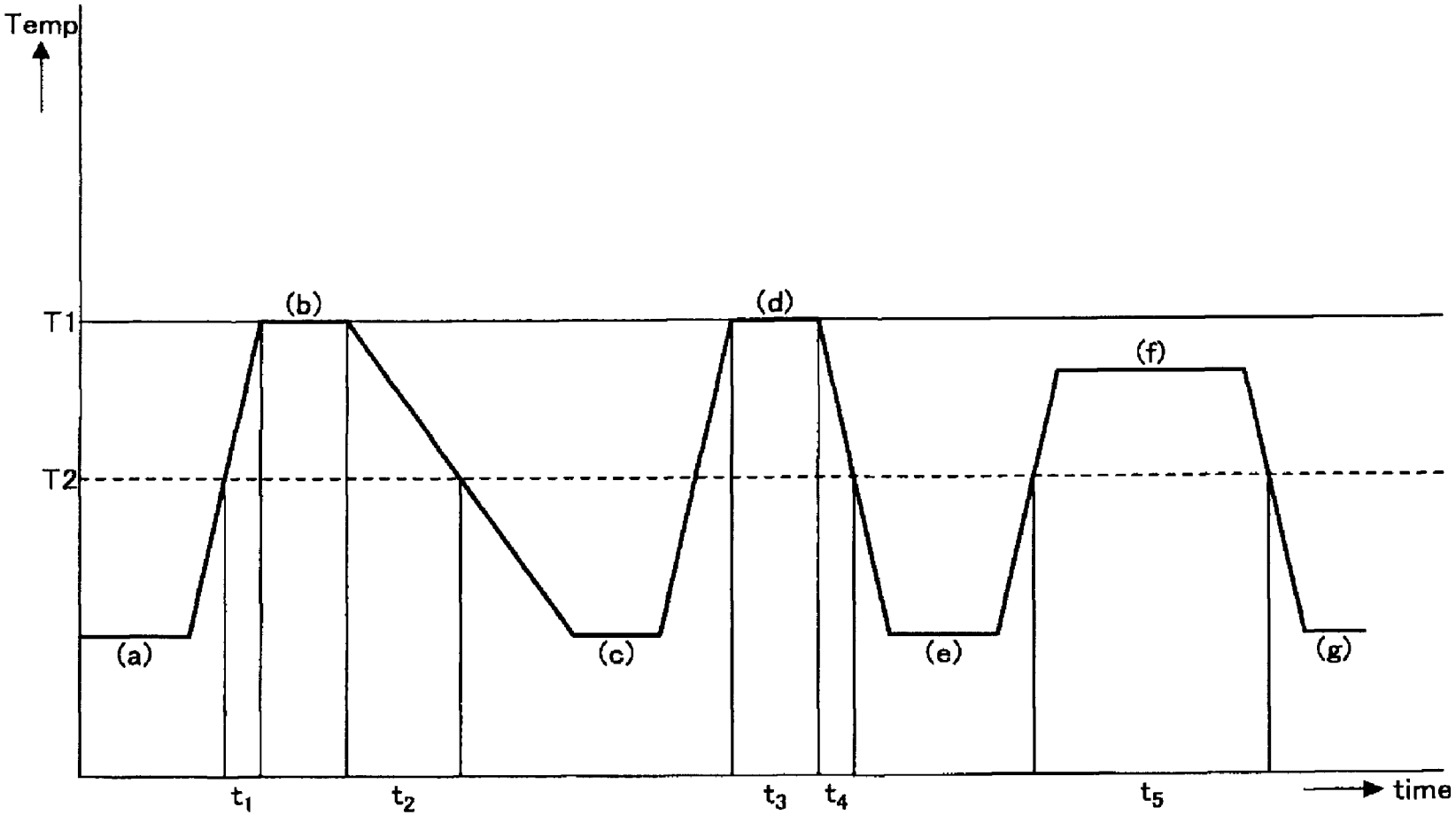
FIG. 6 is a diagram for explaining how a reversible thermosensitive recording material develops and loses color.

For the method for forming the gas barrier layer in the present invention, any method can be employed as long as it allows the gas barrier layer to be applied over the reversible thermosensitive recording layer, etc.; ideally, a gas barrier resin mixed solution is applied over the reversible thermosensitive recording layer and then heated and dried. The method for applying the gas barrier resin mixed solution may be selected from ordinary coating methods such as roll coating using a gravure cylinder or the like, doctor knife method, air knife nozzle coating, bar coating, spray coating and dip coating, and these coating methods may be used in combination. In the gas barrier layer, it is desirable that the inorganic layered compound be dispersed in such a manner as to align parallel to the gas barrier layer. On this point, formation of the gas barrier layer in accordance with the coating method makes it easier for the inorganic layered compound to disperse in such a manner as to align parallel to the gas barrier layer. In FIG. 5, a cross-sectional view of a gas barrier layer 4 in a reversible thermosensitive recording material of the present invention is schematically shown. As shown in FIG. 5, when an inorganic layered compound 9 is dispersed in a solvent, resin, etc. and the dispersion liquid is formed in the shape of a layer so as to serve as the gas barrier layer 4, the inorganic layered compound 9 has a natural tendency to align flat in the layer direction. The inorganic layered compound tends to align in the shape of layers particularly in a gas barrier resin 8 as shown in FIG. 5. When the inorganic layered compound 9 thusly aligns in the shape of layers in the gas barrier layer 4, gas molecules such as oxygen and steam gas avoid the inorganic layered compound 9 in vertically permeating through the gas barrier layer 4 from above. Accordingly, the path along which the gas molecules permeate through the gas barrier layer 4 becomes very long in comparison with the cross section of the gas barrier layer 4. Since the resin constituting the gas barrier layer 4 originally has gas barrier properties, the longer the permeation path is, the more improved the gas barrier properties of the gas barrier layer 4 are.

In the case where the gas barrier layer is formed in accordance with the coating method, examples of the method for producing the gas barrier resin mixed solution for coating include the following: (1) a method in which an inorganic layered compound (which may be previously swollen and cleaved in a dispersion medium such as water) is added and mixed into a solution prepared by dissolving a gas barrier resin in a solvent, and the inorganic layered compound is dispersed using an agitator, disperser, etc.; and (2) a method in which a solution prepared by dissolving a gas barrier resin in a solvent is added and mixed into a dispersion liquid (dispersion solution) prepared by swelling and cleaving an inorganic layered compound in a dispersion medium such as water and then cleaving and dispersing the inorganic layered compound with the use of an agitator, disperser, etc. Also, as to each of these examples, when the inorganic layered compound is a natural product, it is desirable to add into the mixed solution a compound containing an alkali metal ion or alkaline earth metal ion, such as magnesium hydroxide or calcium hydroxide.

For the solvent in which the gas barrier resin is dissolved, any one of an aqueous solvent and a nonaqueous solvent, both of which are capable of dissolving polyvinyl alcohol polymers and ethylene-vinyl alcohol copolymers, may be used; however, use of water is preferable for its harmlessness to the environment.

Also, when an ethylene-vinyl alcohol copolymer is used for the gas barrier resin, it is desirable for the gas barrier resin solution to be made using a mixed solvent of water and a lower alcohol, and a terminal-modified ethylene-vinyl alcohol copolymer which has been reduced in molecular weight by being treated with a peroxide or the like. In this case, use of a mixed solvent containing 50% by mass to 85% by mass of water and 15% by mass to 50% by mass of at least one lower alcohol selected from lower alcohols having 2 to 4 carbon atoms such as ethyl alcohol, n-propyl alcohol, isopropyl alcohol, n-butyl alcohol, isobutyl alcohol, sec-butyl alcohol and tert-butyl alcohol is suitable in that the solubility of the ethylene-vinyl alcohol copolymer improves and also an appropriate solid content can be maintained. When the lower alcohol content in the mixed solvent is more than 50% by mass, the inorganic layered compound is insufficiently cleaved on the occasion of the after-mentioned dispersion of the inorganic layered compound. Note that n-propyl alcohol and isopropyl alcohol are preferable among the lower alcohols having 2 to 4 carbon atoms.

The agitator and the disperser used for forming the gas barrier resin mixed solution are not particularly limited as long as they are an ordinary agitator and an ordinary disperser, and the inorganic layered compound can be uniformly dispersed in the dispersion liquid by using these. However, use of a high-pressure disperser, an ultrasonic disperser, etc. is preferable in that a transparent, stable inorganic layered compound dispersion liquid can be obtained. Examples of the high-pressure disperser include NANOMIZER (trade name, manufactured by Nanomizer Co., Ltd.), MICROFLUIDIZER (trade name, manufactured by Microfluidics), ULTIMIZER (trade name, manufactured by Sugino Machine Limited), DEBEE (trade name, manufactured by BEE International, Inc.) and NIRO SOAVI HOMOGENIZER (trade name, manufactured by Niro Soavi), and it is desirable that dispersion be carried out at 1 MPa to 100 MPa as a pressure condition for these high-pressure dispersers. When the pressure is higher than 100 MPa, the inorganic layered compound is easily pulverized and made into extremely fine powder, and there is a decrease in gas passageway length, thereby possibly leading to a degradation of target gas barrier properties. When the pressure is lower than 1 MPa, there may be such a trouble caused that dispersion of the inorganic layered compound does not proceed or a great deal of time is spent on dispersion.

It is desirable that at least one of a silane coupling agent, an isocyanate compound, an aziridine compound and a carbodiimide compound, which serve as adhesiveness improvers added so as to improve adhesiveness between the gas barrier layer and other layers adjacent thereto, be added after the inorganic layered compound has been dispersed into the gas barrier resin. By thusly forming the gas barrier layer, the gas barrier properties of the reversible thermosensitive recording material improve dramatically, and also resistance to detachment of the gas barrier layer caused by moisture and the like improves.

[Close Contact Layer and Anchor Coat Layer]

When the gas barrier layer is provided on the reversible thermosensitive recording layer, it is desirable that an adhesive and/or an anchor coat agent be applied over the reversible thermosensitive recording layer so as to form at least one close contact layer and/or at least one anchor coat layer, and subsequently the gas barrier layer be formed. The close contact layer can have a function of improving adhesiveness between the reversible thermosensitive recording layer and the gas barrier layer, a function of preventing change in the quality of the reversible thermosensitive recording layer caused by the application of the gas barrier layer, and a function of preventing additives contained in the gas barrier layer from transferring to the reversible thermosensitive recording layer or preventing additives contained in the reversible thermosensitive recording layer from transferring to the protective layer. The anchor coat layer can have a function of improving adhesiveness between the reversible thermosensitive recording layer and the gas barrier layer or the close contact layer.

Examples of the adhesive include isocyanate-based, urethane-based and acrylic-based adhesives for lamination. Examples of the anchor coat agent include titanium-based, isocyanate-based, imine-based and polybutadiene-based anchor coat agents for lamination. Additionally, these adhesives and anchor coat agents may contain materials for improving adhesiveness, such as cross-linking agents.

Solvents used in coating solutions of the close contact layer and the anchor coat layer, a disperser for dispersing the coating solutions, binders, a coating method, a drying and hardening method and the like may be selected from known compounds, products, methods and the like used for the recording layer. The method for providing layers that form the close contact layer and the anchor coat layer may be a coating method similar to the one used for the gas barrier layer.

The thicknesses of the close contact layer and the anchor coat layer are preferably in the range of 0.1 μm to 20 μm each, more preferably in the range of 0.3 μm to 10 μm each.

[Reversible Thermosensitive Recording Layer]

The thermosensitive recording layer in the reversible thermosensitive recording material of the present invention is basically a thin layer formed of a composition in which a color former and a developer are dispersed in a binder resin. In this composition, additives for improving and/or controlling the coating properties, color-developing and color-erasing properties, etc. of the thermosensitive recording layer may also be used in accordance with the necessity. Examples of these additives include a controlling agent, a surfactant, a conductive agent, a filling agent, an antioxidant, a light stabilizer and a color development stabilizer.

(Color Former)

The color former used in the present invention is an electron-donating color-forming compound, namely a dye precursor (leuco dye) which is colorless or pale per se. The color former is not particularly limited, and examples thereof include fluoran compounds, triphenylmethane phthalide compounds, azaphthalide compounds, phenothiazine compounds, leucoauramine compounds and indolinophthalide compounds.

Specific examples of the color former as fluoran compounds and azaphthalide compounds include 2-anilino-3-methyl-6-diethylaminofluoran,
2-anilino-3-methyl-6-di(n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-methylamino)fluoran,
2-anilino-3-methyl-6-(N-n-amyl-N-ethylamino)fluoran,
2-anilino-3-methyl-6-(N-iso-amyl-N-ethylamino)fluoran,
2-anilino-3-methyl-6-(N-n-propyl-N-isopropylamino)fluoran,
2-anilino-3-methyl-6-(N-cyclohexyl-N-methylamino)fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino)-3-methyl-6-diethylaminofluoran,
2-(m-trichloromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-ethylanilino)fluoran,
2-(N-ethyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-chloroanilino)-6-dibutylaminofluoran,
2-(m-trifluoromethylanilino)-6-diethylaminofluoran,
2,3-dimethyl-6-dimethylaminofluoran,
3-methyl-6-(N-ethyl-p-toluidino)fluoran,
2-chloro-6-diethylaminofluoran, 2-bromo-6-diethylaminofluoran,
2-chloro-6-dipropylaminofluoran, 3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
3-diethylamino-6-(m-trifluoromethylanilino)fluoran,
3-(1-ethyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide,
3-(1-octyl-2-methylindole-3-yl)-3-(2-ethoxy-4-diethylaminophenyl)-4-azaphthalide,
3-(1-ethyl-2-methylindole-3-yl)-3-(2-methyl-4-diethylaminophenyl)-4-azaphthalide,
3-(1-ethyl-2-methylindole-3-yl)-3-(2-methyl-4-diethylaminophenyl)-7-azaphthalide,
3-(1-ethyl-2-methylindole-3-yl)-3-(4-diethylaminophenyl)-4-azaphthalide,
3-(1-ethyl-2-methylindole-3-yl)-3-(4-N-n-amyl-N-methylaminophenyl)-4-azaphthalide,
3-(1-methyl-2-methylindole-3-yl)-3-(2-hexyloxy-4-diethylaminophenyl)-4-azaphthalide,
3,3-bis(2-ethoxy-4-diethylaminophenyl)-4-azaphthalide and
3,3-bis(2-ethoxy-4-diethylaminophenyl)-7-azaphthalide.

The color former used in the present invention may also be selected from conventionally known leuco dyes, besides the fluoran compounds and the azaphthalide compounds. Specific examples thereof include 2-(p-acetylanilino)-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-benzylamino-6-(N-methyl-p-toluidino)fluoran,
2-benzylamino-6-(N-ethyl-p-toluidino)fluoran,
2-(di-p-methylbenzylamino)-6-(N-ethyl-p-toluidino)fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran, 2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
1,2-benzo-6-(N-ethyl-N-isoamylamino)fluoran,
1,2-benzo-6-dibutylaminofluoran,
1,2-benzo-6-(N-methyl-N-cyclohexylamino)fluoran and
1,2-benzo-6-(N-ethyl-N-toluidino)fluoran. Each of these color formers may be used alone or in combination.

It is normally desirable that the leuco dye have an average particle diameter of 0.05 μm to 0.7 μm, more desirably 0.1 μm to 0.5 μm, even more desirably 0.1 μm to 0.3 μm. The color-developing properties of the thermosensitive recording layer can be improved by the average particle diameter of the leuco dye being in the above-mentioned range. The leuco dye may be dispersed with addition of a dispersant and/or a surfactant in accordance with the necessity to adjust its average particle diameter to the range of 0.05 μm to 0.7 μm. It is advisable to add the dispersant and/or the surfactant by 5% by mass to 20% by mass in relation to the leuco dye. As a disperser, a ball mill, an attritor, a sand mill, a high-pressure jet mill or the like can be used. A method using a medium such as balls is preferable as a means for microparticulation and dispersion of the leuco dye, and the leuco dye can be microparticulated by dispersing it with the use of a zirconia medium of 0.5 mm or less in diameter from the beginning, or coarsely pulverizing it with the use of a zirconia medium of 0.5 mm to 1.0 mm in diameter first and then dispersing it with the use of a zirconia medium of 0.5 mm or less in diameter.

Additionally, the average particle diameters of compound particles constituting the leuco dye and compound particles constituting the after-mentioned developer in the present invention are measured in accordance with a laser analysis and scattering method (for instance, using Microtrac HRA9320-X100, LA920 manufactured by Horiba, Ltd., or Lasentec FBRM).

(Developer)

For the developer used in the thermosensitive recording layer of the reversible thermosensitive recording material of the present invention, any compound may be used as long as it is an electron-accepting compound and has a function of making the color former (leuco dye) develop color. Examples of conventionally known developers include organic phosphoric acid compounds, aliphatic carboxylic acid compounds, phenol compounds, and metal salts and phosphates of mercaptoacetic acid. It is advisable to select the developer from these compounds in view of the melting point, color-developing performance, etc. and in combination with the color former.

In the present invention, it is desirable that the electron-accepting compound used in the reversible thermosensitive recording layer be a compound represented by the following General Formula (1) in view of color-developing density and color-erasing properties.

General Formula (1)

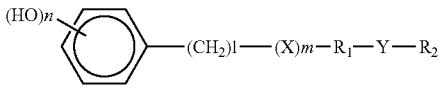

(In this formula, 1 denotes a natural number of 0 to 2, m denotes 0 or 1, n denotes an integer of 1 to 3, and X and Y each denote a divalent group including a nitrogen atom or oxygen atom. Meanwhile, $R_1$ denotes an aliphatic hydrocarbon group having two or more carbon atoms, which may have a substituent, and $R_2$ denotes an aliphatic hydrocarbon group having one carbon atom or more.)

In General Formula (1), each of the aliphatic hydrocarbon groups may have a straight chain or branched chain and may have an unsaturated bond. Examples of the substituent that bonds to the hydrocarbon group include hydroxyl group, halogen atom and alkoxy group. Since there is a degradation of color-developing stability and color-erasing property when the sum of the numbers of carbon atoms contained in $R_1$ and $R_2$ is 7 or less, it is desirable that the sum of the numbers of carbon atoms be 8 or greater, more desirably 11 or greater.

Suitable examples of $R_1$ include the groups shown immediately below.

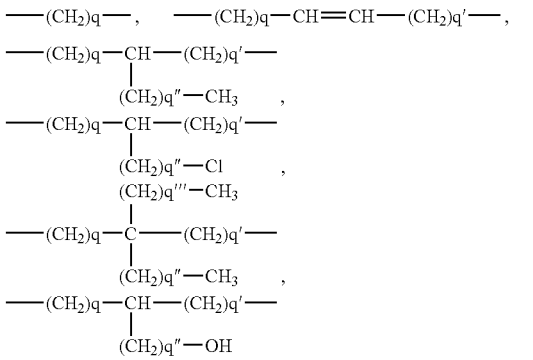

In these formulae, q, q', q'' and q''' each denote an integer which satisfies the prescribed numbers of carbon atoms contained in $R_1$ and $R_2$. It is particularly desirable that $R_1$ be —$(CH_2)q$- among these groups.

Meanwhile, suitable examples of $R_2$ include the groups shown immediately below.

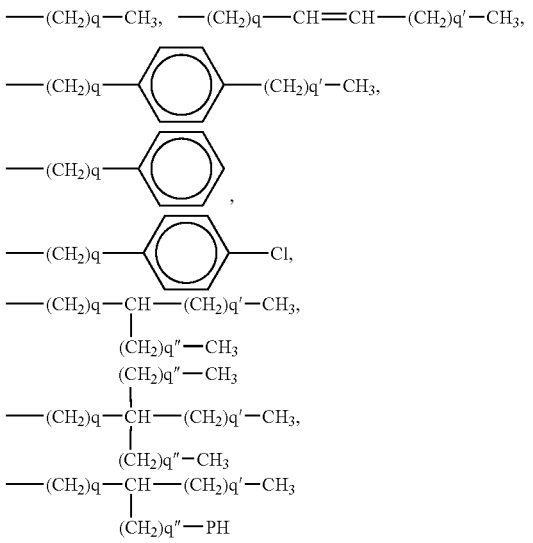

In these formulae, q, q', q'' and q''' are the same as those mentioned above. It is particularly desirable that $R_2$ be —$(CH_2)q$-$CH_3$ among these groups.

X and Y each denote a divalent group including a nitrogen atom or oxygen atom, preferably a divalent group having at least one of the following groups.

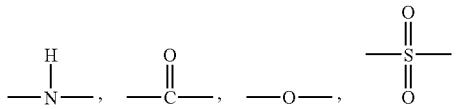

Specific examples of X and Y include the groups shown immediately below.

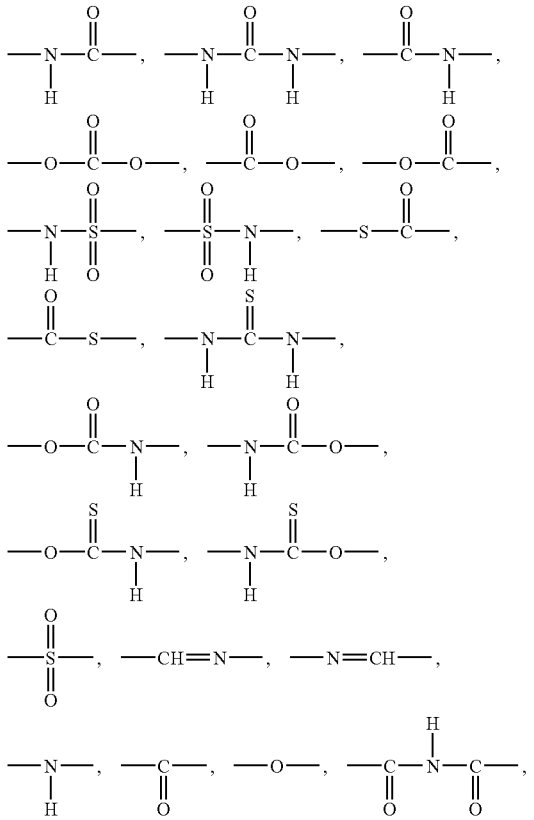

-continued

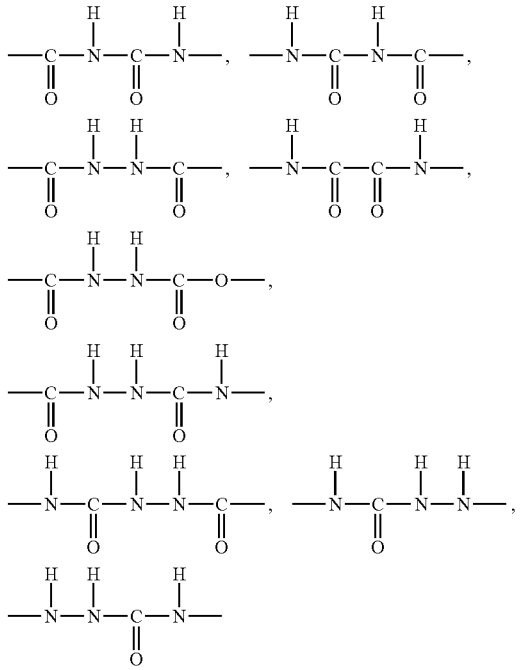

Among these groups, the following are particularly preferable.

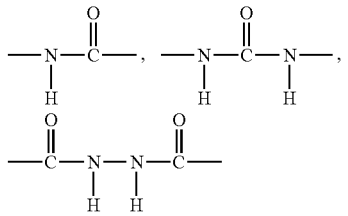

Specific examples of compounds represented by General Formula (1) include the following compounds. It should, however, be noted that the developer in the present invention is not confined to these compounds.

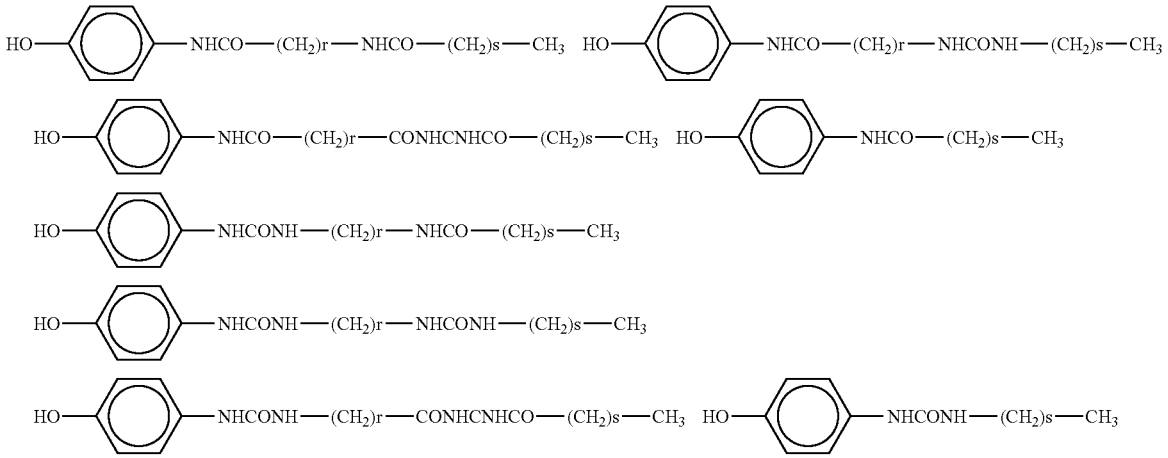

-continued

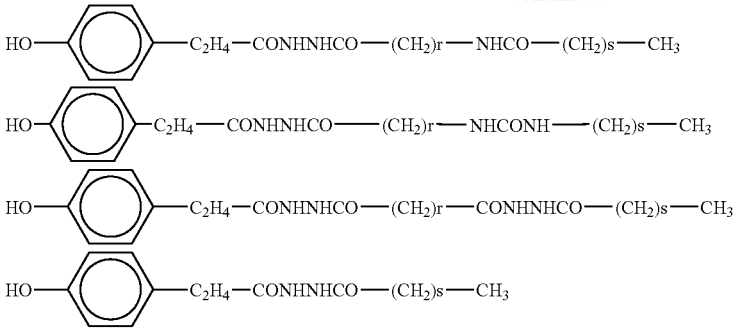

In these formulae, r denotes an integer of 2 or greater, and s denotes an integer of 1 or greater.

It is desirable that the average particle diameter of the developer be in the range of 0.1 μm to 2.5 μm, more desirably in the range of 0.5 μm to 2.0 μm. In the case where the developer has an average particle diameter of 0.1 μm to 2.5 μm, color-developing properties can be improved when used as the developer for the thermosensitive recording material of the present invention. Further, in the case where the developer has an average particle diameter of 0.5 μm to 2.0 μm, such an effect is particularly remarkable.

Although a suitable range for the proportion of the color former to the developer varies according to the combination of compounds used therefor, the molar ratio of the color former to the developer is approximately in the range of 1:0.1 to 1:20, preferably in the range of 1:0.2 to 1:10. When the proportion of the developer is so small as to be outside this range, it is problematic because the density in a color-developed state decreases. The color former and the developer may be used, being encapsulated in microcapsules. The proportion of color-developing components to resin in the reversible thermosensitive recording layer is preferably in the range of 1:0.1 to 1:10. When the resin occupies a smaller proportion, the reversible thermosensitive recording layer is deficient in thermal strength. When the resin occupies a larger proportion, it is problematic because the color-developing density decreases.

The developer may be dispersed along with the leuco dye, with addition of a dispersant and/or a surfactant in accordance with the necessity to adjust its average particle diameter to the range of 0.05 μm to 0.7 μm. It is advisable to add the dispersant and/or the surfactant by 5% by mass to 20% by mass in relation to the leuco dye. As a disperser, a ball mill, an attritor, a sand mill, a high-pressure jet mill or the like can be used. A method using a medium such as balls is preferable as a means for microparticulation and dispersion of the developer, and the developer can be microparticulated by dispersing it with the use of a zirconia medium of 0.5 mm or less in diameter from the beginning, or coarsely pulverizing it with the use of a zirconia medium of 0.5 mm to 1.0 mm in diameter first and then dispersing it with the use of a zirconia medium of 0.5 mm or less in diameter.

(Controlling Agent)

It is desirable that the controlling agent used in the reversible thermosensitive recording layer in the present invention be selected from compounds containing amide groups, urethane groups, urea groups, ketone groups, diacylhydrazide groups, etc. as their partial structures, in view of color-developing density and color-erasing properties. Among these, compounds containing amide groups, secondary amide groups and urethane groups are particularly preferable, and specific examples thereof include the following compounds.

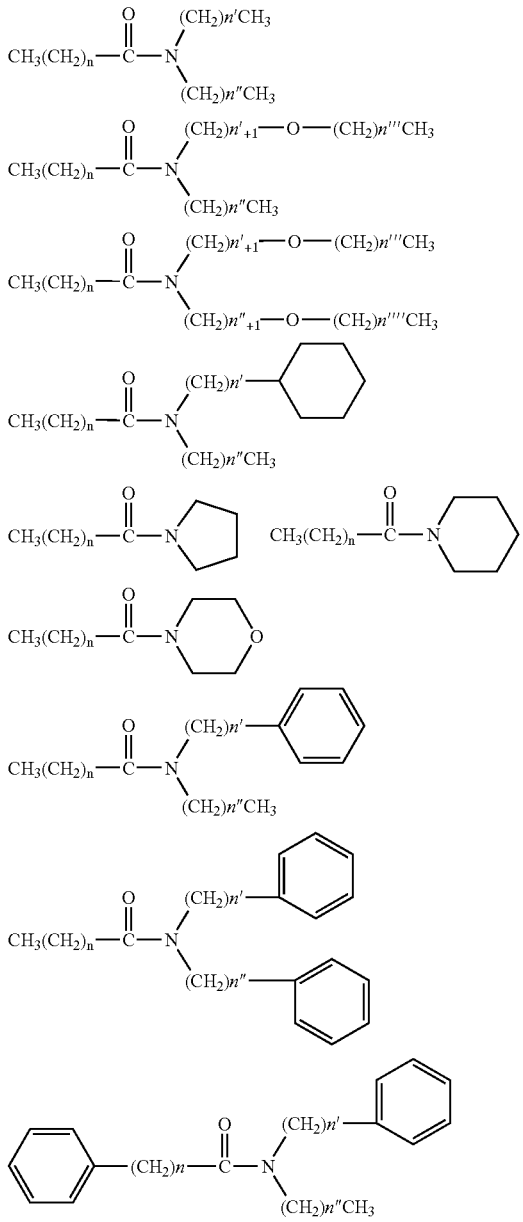

-continued

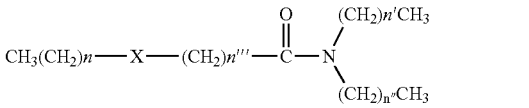

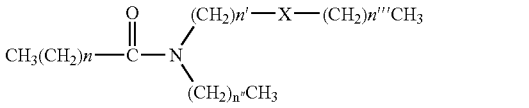

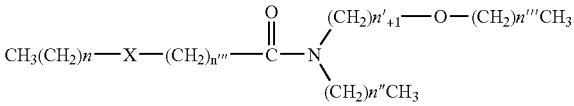

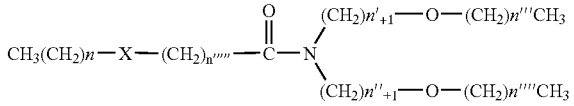

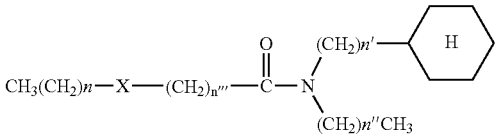

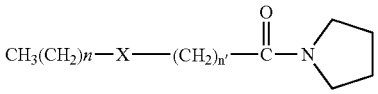

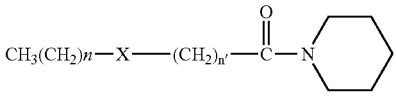

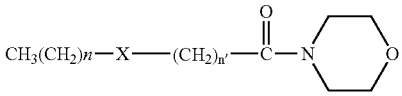

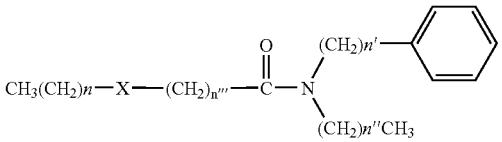

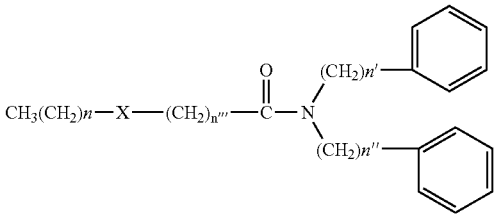

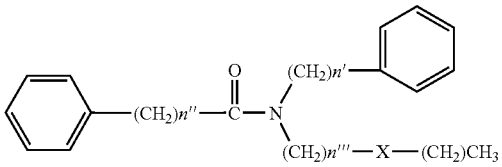

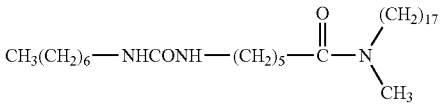

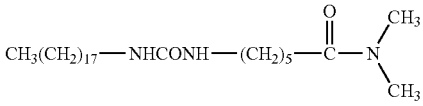

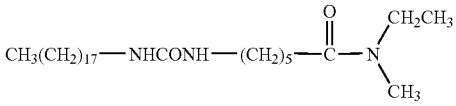

-continued

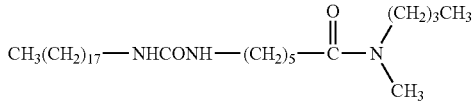

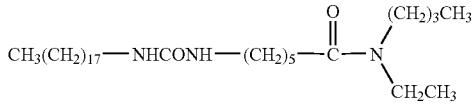

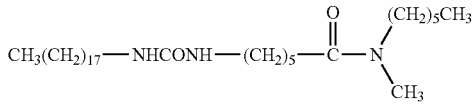

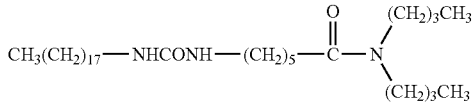

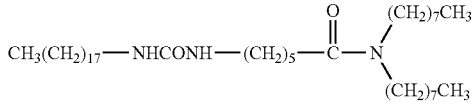

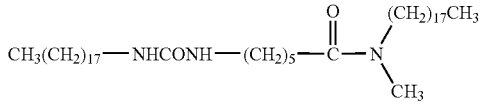

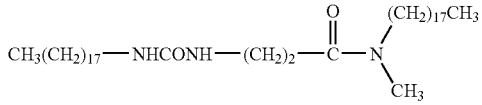

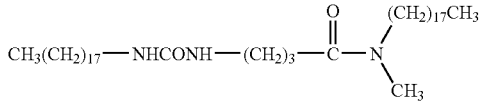

In these formulae, n, n', n'', n''' and n'''' each denote an integer of 0 to 21. However, it is not allowed that all of them are 5 or less at the same time.

$C_{11}H_{23}CONHC_{12}H_{25}$, $C_{15}H_{31}CONHC_{16}H_{33}$, $C_{17}H_{35}CONHC_{18}H_{37}$, $C_{17}H_{35}CONHC_{18}H_{35}$, $C_{21}H_{41}CONHC_{18}H_{37}$, $C_{15}H_{31}CONHC_{18}H_{37}$, $C_{17}H_{35}CONHCH_2HNOCC_{17}H_{35}$, $C_{11}H_{23}CONHCH_2HNOCC_{11}H_{23}$, $C_7H_{15}CONHC_2H_4HNOCC_{17}H_{35}$, $C_9H_{19}CONHC_2H_4HNOCC_9H_{19}$, $C_{11}H_{23}CONHC_2H_4HNOCC_{11}H_{23}$, $C_{17}H_{35}CONHC_2H_4HNOCC_{17}H_{35}$, $(CH_3)_2$ $CHC_{14}H_{35}CONHC_2H_4HNOCC_{14}H_{35}(CH_3)_2$, $C_{21}H_{43}CONHC_2H_4HNOCC_{21}H_{43}$, $C_{17}H_{35}CONHC_6H_{12}HNOCC_{17}H_{35}$, $C_{21}H_{43}CONHC_6H_{12}HNOCC_{21}H_{43}$, $C_{17}H_{33}CONHCH_2HNOCC_{17}H_{33}$, $C_{17}H_{33}CONHC_2H_4HNOCC_{17}H_{33}$, $C_{21}H_{41}CONHC_2H_4HNOCC_{21}H_{41}$, $C_{17}H_{33}CONHC_6H_{12}HNOCC_{17}H_{33}$, $C_8H_{17}NHCOC_2H_4CONHC_{18}H_{37}$, $C_{10}H_{21}NHCOC_2H_4CONHC_{10}H_{21}$, $C_{12}H_{25}NHCOC_2H_4CONHC_{12}H_{25}$, $C_{18}H_{37}NHCOC_2H_4CONHC_{18}H_{37}$, $C_{21}H_{43}NHOCC_2H_4CONHC_{21}H_{43}$, $C_{18}H_{37}NHOCC_6H_{12}CONHC_{18}H_{37}$, $C_{18}H_{35}NHCOC_4H_8CONHC_{18}H_{35}$, $C_{18}H_{35}NHCOC_8H_{16}CONHC_{18}H_{35}$, $C_{12}H_{25}OCONHC_{18}H_{37}$, $C_{13}H_{27}OCONHC_{18}H_{37}$, $C_{16}H_{33}OCONHC_{18}H_{37}$, $C_{18}H_{37}OCONHC_{18}H_{37}$, $C_{21}H_{43}OCONHC_{18}H_{37}$, $C_{12}H_{25}OCONHC_{16}H_{33}$, $C_{13}H_{27}OCONHC_{16}H_{33}$, $C_{16}H_{33}OCONHC_{16}H_{33}$, $C_{18}H_{37}OCONHC_{16}H_{33}$, $C_{21}H_{43}OCONHC_{16}H_{33}$,
$C_{12}H_{25}OCONHC_{14}H_{29}$, $C_{13}H_{27}OCONHC_{14}H_{29}$,
$C_{16}H_{33}OCONHC_{14}H_{29}$, $C_{18}H_{37}OCONHC_{14}H_{29}$,
$C_{22}H_{45}OCONHC_{14}H_{29}$, $C_{12}H_{25}OCONHC_{12}H_{37}$,
$C_{13}H_{27}OCONHC_{12}H_{37}$, $C_{16}H_{33}OCONHC_{12}H_{37}$,
$C_{18}H_{37}OCONHC_{12}H_{37}$, $C_{21}H_{43}OCONHC_{12}H_{37}$,
$C_{22}H_{45}OCONHC_{18}H_{37}$,
$C_{18}H_{37}NHCOOC_2H_4OCONHC_{18}H_{37}$,
$C_{18}H_{37}NHCOOC_3H_6OCONHC_{18}H_{37}$,
$C_{18}H_{37}NHCOOC_4H_8OCONHC_{18}H_{37}$,
$C_{18}H_{37}NHCOOC_6H_{12}OCONHC_{18}H_{37}$,
$C_{18}H_{37}NHCOOC_8H_{16}OCONHC_{18}H_{37}$,
$C_{18}H_{37}NHCOOC_2H_4OC_2H_4OCONHC_{18}H_{37}$,
$C_{18}H_{37}NHCOOC_3H_6OC_3H_6OCONHC_{18}H_{37}$,
$C_{18}H_{37}NHCOOC_{12}H_{24}OCONHC_{18}H_{37}$,
$C_{18}H_{37}NHCOOC_2H_4OC_2H_4OC_2H_4OCONHC_{18}H_{37}$,
$C_{16}H_{33}NHCOOC_2H_4OCONHC_{16}H_{33}$,
$C_{16}H_{33}NHCOOC_3H_6OCONHC_{16}H_{33}$,
$C_{16}H_{33}NHCOOC_4H_8OCONHC_{16}H_{33}$,
$C_{16}H_{33}NHCOOC_6H_{12}OCONHC_{16}H_{33}$,
$C_{16}H_{33}NHCOOC_8H_{16}OCONHC_{16}H_{33}$,
$C_{18}H_{37}OCOHNC_6H_{12}NHCOOC_{18}H_{37}$,
$C_{16}H_{33}OCOHNC_6H_{12}NHCOOC_{16}H_{33}$,
$C_{14}H_{29}OCOHNC_6H_{12}NHCOOC_{14}H_{29}$,
$C_{12}H_{25}OCOHNC_6H_{12}NHCOOC_{12}H_{25}$,
$C_{10}H_{21}OCOHNC_6H_{12}NHCOOC_{10}H_{21}$ and
$C_8H_{17}OCOHNC_6H_{12}NHCOOC_8H_{17}$.

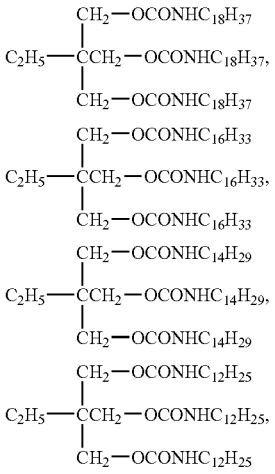

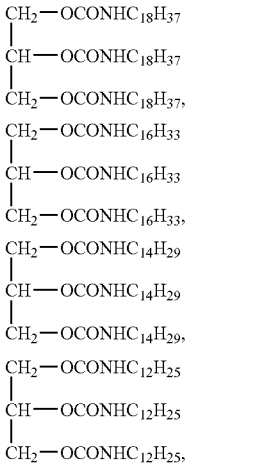

-continued

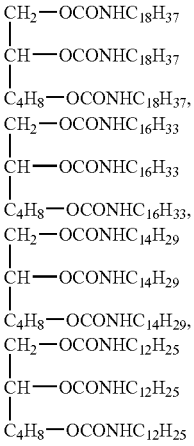

Each of these controlling agents may be used alone or in combination.

As for the proportion of a color-erasing accelerator, which is the controlling agent, to the developer, it is desirable that the color-erasing accelerator be in the range of 0.1% by mass to 300% by mass, more desirably in the range of 3% by mass to 100% by mass. It is advisable to add the controlling agent such that when the color former and the developer are mixed together, the controlling agent is evenly mixed therewith.

(Binder Resin)

The function of the binder resin used for forming the reversible thermosensitive recording layer is to maintain a state in which materials of the composition are evenly dispersed without being biased by heat application for recording and erasure. Examples of the binder resin include polyvinyl chloride, polyvinyl acetate, vinyl chloride-vinyl acetate copolymers, ethyl cellulose, polystyrene, styrene copolymers, phenoxy resins, polyesters, aromatic polyesters, polyurethanes, polycarbonates, polyacrylic acid esters, polymethacrylic acid esters, acrylic acid copolymers, maleic acid copolymers, polyvinyl alcohol, modified polyvinyl alcohols, hydroxyethyl cellulose, carboxymethyl cellulose and starches. Among these binder resins, use of those having high heat resistance is preferable. To improve the heat resistance of the binder resin, a binder resin may be used which has been cross-linked by means of heat, an ultraviolet ray, an electron beam or a cross-linking agent, for example.

Specific examples of the binder resin in a cross-linked state in the present invention include resins each having a group which reacts with a cross-linking agent, such as acrylic polyol resins, polyester polyol resins, polyurethane polyol resins, phenoxy resins, polyvinyl butyral resins, cellulose acetate propionate and cellulose acetate butyrate; and resins produced in such a manner that monomers each having a group which reacts with a cross-linking agent are copolymerized with other monomers. It should, however, be noted that the binder resin in the present invention is not confined to these compounds.

Acrylic polyol resins vary in property depending upon structure; as hydroxyl monomers, hydroxyethyl acrylate (HEA), hydroxypropyl acrylate (HPA), 2-hydroxyethyl methacrylate (HEMA), 2-hydroxypropyl methacrylate (HPMA), 2-hydroxybutyl monoacrylate (2-HBA), 1,4-hydroxybutyl monoacrylate (1-HBA) and the like are used, with 2-hydroxyethyl methacrylate being preferable because the crack resistance and durability of coating films improve particularly when monomers having primary hydroxyl groups are used.

Examples of the cross-linking agent include conventionally known isocyanates, amines, phenols and epoxy compounds. Among these, isocyanate curing agents are preferable. An isocyanate compound used herein is selected from modified compounds of known isocyanate monomers, including urethane-modified compounds, allophanate-modified compounds, isocyanurate-modified compounds, burette-modified compounds and carbodiimide-modified compounds thereof, and blocked isocyanates. Examples of the isocyanate monomers forming the modified compounds include tolylene diisocyanate (TDI), 4,4'-diphenylmethane diisocyanate (MDI), xylylene diisocyanate (XDI), naphthylene diisocyanate (NDI), paraphenylene diisocyanate (PPDI), tetramethylxylylene diisocyanate (TMXDI), hexamethylene diisocyanate (HDI), dicyclohexylmethane diisocyanate (HMDI), isophorone diisocyanate (IPDI), lysine diisocyanate (LDI), isopropylidenebis(4-cyclohexyl isocyanate) (IPC), cyclohexyl diisocyanate (CHDI) and tolidine diisocyanate (TODI). It should, however, be noted that the cross-linking agent is not confined to these compounds.

Further, a catalyst used in the reaction may be utilized as a cross-linking accelerator. Examples of the cross-linking accelerator include tertiary amines such as 1,4-diaza-bicyclo [2,2,2]octane, and metal compounds such as organic tin compounds. Also, the whole amount of the cross-linking agent added may or may not be subjected to cross-linking reaction. In other words, an unreacted cross-linking agent may be present. This kind of cross-linking reaction proceeds with time; therefore, the presence of an unreacted cross-linking agent does not show that a cross-linking reaction is not proceeding at all, and so if an unreacted cross-linking agent is detected, it does not mean that a resin in a cross-linked state is not present. As to a method for distinguishing between a cross-linked state and a non-cross-linked state of a polymer in the present invention, these two states can be distinguished by immersing a coating film in a solvent having high dissolving ability. Specifically, with respect to a polymer in a non-cross-linked state, the polymer dissolves in the solvent and thus does not remain in a solute; accordingly, it is reasonable to analyze the existence or absence of a polymer structure in the solute. In this case, when the existence of a polymer structure in the solute is not confirmed, it means that the polymer is in a non-cross-linked state, which makes it possible to distinguish the polymer from a polymer in a cross-linked state. Here, the difference can be expressed by the gel fraction.

The gel fraction is defined as follows: when a resin solute loses independent mobility in a solvent because of interaction, then accumulates and gets into a solidified state (forms a gel), the production ratio of the gel is denoted by the gel fraction. The gel fraction of the resin is preferably 30% or greater, more preferably 50% or greater, even more preferably 70% or greater, most preferably 80% or greater. The durability of the resin against repeated use degrades when the gel fraction is small; to improve the gel fraction, it is advisable to mix into the resin a curable resin which cures by heat, an ultraviolet ray, an electron beam, etc. or to cross-link the resin itself.

The method for measuring the gel fraction is as follows: a film is detached from a support, and the initial weight of the film is measured; thereafter, the film is fastened to a 400-mesh wire netting and immersed for 24 hr in a solvent in which a resin not yet cross-linked is soluble; subsequently the film is dried in a vacuum, and then the post-drying weight of the film is measured.

The gel fraction is calculated according to the following equation.

$$\text{Gel fraction (\%)} = [\text{Post-drying weight (g)}/\text{Initial weight (g)}] \times 100$$

As to this calculation, the gel fraction is calculated such that the weight of components other than resin components in a thermosensitive layer, such as organic low-molecular material particles, is excluded. On this occasion, if the organic low-molecular material weight is not previously known, it is advisable to calculate the area ratio of the organic low-molecular material to a unit area by cross-sectional observation in accordance with TEM, SEM, etc. and the weight ratio thereof based upon the specific gravity of the resin and that of the organic low-molecular material so as to work out the organic low-molecular material weight and thus the gel fraction.

Also in the measurement, when a reversible thermosensitive recording layer is provided on the support, and other layer(s) such as a protective layer is/are laid over the reversible thermosensitive recording layer or there is/are other layer(s) between the support and the reversible thermosensitive recording layer, it is advisable to check the thicknesses of the reversible thermosensitive recording layer and the other layer(s) by the above-mentioned cross-sectional observation in accordance with TEM, SEM, etc., shave off a surface corresponding to the thicknesses of the other layer(s) with the intention of exposing the reversible thermosensitive recording layer surface and detaching the reversible thermosensitive recording layer, and then calculate the gel fraction as described above.

In the case where a protective layer and/or the like formed of an UV-curable resin, etc. and/is provided over a reversible thermosensitive recording layer in this method, it is necessary to shave off a surface corresponding to the thickness(es) of the protective layer and/or the like and slightly shave the reversible thermosensitive recording layer surface with the intention of preventing mixing of the protective layer and/or the like as much as possible, and thereby to prevent the gel fraction values from being affected.

(Reversible Thermosensitive Recording Layer Composition)

The thermosensitive recording layer in the present invention is formed of a composition in which a color former and a developer are finely and uniformly dispersed in a binder resin. Although the color former and the developer may independently form particles, it is more desirable that composite particles of the color former and the developer be dispersed. This can be achieved by melting or dissolving the color former and the developer. Such a reversible thermosensitive recording layer composition can be applied over a support as a mixed solution prepared by dispersing or dissolving materials in respective solvents and then mixing the solutions or as a mixed solution prepared by mixing materials together and then dispersing or dissolving the mixed materials in a solvent. The color former and the developer may be used, being encapsulated in microcapsules.

The reversible thermosensitive recording layer composition is a coating solution prepared by uniformly mixing and dispersing a mixture composed of a color former, a developer, various additives, a curing agent, a resin in a cross-linked state, a coating solvent and the like. Specific examples of the solvent used in preparing the coating solution include water; alcohols such as methanol, ethanol, isopropanol, n-butanol and methylisocarbinol; ketones such as acetone, 2-butanone, ethyl amyl ketone, diacetone alcohol, isophorone and cyclohexane; amides such as N,N-dimethylformamide and N,N-dimethylacetamide; ethers such as diethyl ether, isopropyl ether, tetrahydrofuran, 1,4-dioxane and 3,4-dihydro-2H-pyran; glycol ethers such as 2-methoxyethanol, 2-ethoxyethanol, 2-butoxyethanol and ethylene glycol dimethyl ether; glycol ether acetates such as 2-methoxyethyl acetate, 2-ethoxyethyl acetate and 2-butoxyethyl acetate; esters such as methyl acetate, ethyl acetate, isobutyl acetate, amyl acetate, ethyl lactate and ethylene carbonate; aromatic hydrocarbons such as benzene, toluene and xylene; aliphatic hydrocarbons such as hexane, heptane, isooctane and cyclohexane; halogenated hydrocarbons such as methylene chloride, 1,2-dichlorethane, dichloropropane and chlorbenzene; sulfoxides such as dimethyl sulfoxide; and pyrrolidones such as N-methyl-2-pyrrolidone and N-octyl-2-pyrrolidone.

The coating solution can be prepared using a known coating solution disperser such as a paint shaker, a ball mill, an attritor, a three-roll mill, a keddy mill, a sand mill, a dyno mill or a colloid mill. Also, the materials may be dispersed into a solvent using the coating solution disperser; alternatively, the materials may be independently dispersed into respective solvents, and then the solutions may be mixed together. Further, the materials may be dissolved by heating and then precipitated by rapid cooling or removal of cooling.

(Support)

The reversible thermosensitive recording material of the present invention includes a support, and a thermosensitive recording layer containing the above-mentioned composition as a main component, provided over the support. Anything may be used as the support as long as it is paper, resin film, PET film, synthetic paper, metal foil, glass, a combined material thereof, or the like and can hold the thermosensitive recording layer. To form the support, a material having a necessary thickness may be used alone, or several materials having a necessary thickness may be stuck together, for example. Such a support may have a magnetic recording layer, an IC chip, etc. inside it, or on its surface on the same or opposite side to the reversible thermosensitive recording layer, for example. The thickness of the support may be freely selected from the range of approximately several micrometers to approximately several millimeters. When the thermosensitive recording layer has self-supporting properties, the support may be omitted. Additionally, it is normally desirable that the support have oxygen barrier properties and moisture barrier properties; in case the support has inadequate oxygen barrier properties and moisture barrier properties, it is advisable to cover the support with the gas barrier layer as well.

(Formation of Reversible Thermosensitive Recording Layer)

To form the thermosensitive recording layer on the support, it is advisable to use a conventionally known method. For instance, a coating solution of the reversible thermosensitive recording layer composition is applied over the support and dried. The method for applying the coating solution of the reversible thermosensitive recording layer composition is not particularly limited, and examples thereof include conventionally known methods such as blade coating, wire bar coating, spray coating, air knife coating, bead coating, curtain coating, gravure coating, kiss coating, reverse roll coating, dip coating and die coating.

After the coating solution of the reversible thermosensitive recording layer composition has been applied, the coating solution is dried and, if necessary, hardened to complete cross-linkage of the binder resin. With the use of a high-temperature bath or the like, the coating solution may be dried and hardened at a relatively high temperature for a short period of time, or at a relatively low temperature for a long period of time. As for specific conditions of the hardening, in view of reactivity, the coating solution is preferably hardened at a temperature of 30° C. to 130° C. or so for 1 min to 150 hr or so, more preferably at a temperature of 40° C. to 100° C. for 2 min to 120 hr or so. Generally, since productivity is deemed important in industrial production, it is hardly possible to spend a great deal of time on the process of completing cross-linkage of the binder resin. Accordingly, a cross-linking step may be provided separately from the drying step. As for specific conditions of the cross-linking step, the coating solution is preferably heated at a temperature of 40° C. to 100° C. for 2 min to 120 hr or so.

The thickness of the thermosensitive recording layer in the present invention varies according to the types of the color former and the developer; however, it is preferably in the range of 1 μm to 20 μm, more preferably 3 μm to 15 μm. When the thickness is so small as to be outside this range, it is not favorable because there is often imperfect contrast at the time of color development. When the thickness is so large as to be outside this range, it is not favorable because the thermosensitive recording layer decreases in heat sensitivity as a thermosensitive recording material.

[Additive]

Various additives may be used in the reversible thermosensitive recording material of the present invention in accordance with the necessity. Examples of these additives include a dispersant, a surfactant, a conductive agent, a filling agent, a lubricant, an antioxidant, a light stabilizer, a UV absorber, a color development stabilizer, a color-erasing accelerator and a filler.

Other filler(s) not having UV-absorbing properties or UV-shielding properties may be added into each of the reversible thermosensitive recording layer, the close contact layer and the gas barrier layer, and such fillers can be classified into inorganic fillers and organic fillers. Examples of the inorganic fillers include calcium carbonate, magnesium carbonate, silicic anhydride, hydrous silicic acid, hydrous aluminum silicate, hydrous calcium silicate, alumina, iron oxide, calcium oxide, magnesium oxide, chromium oxide, manganese oxide, silica, talc and mica. Examples of the organic fillers include silicone resins, cellulose resins, epoxy resins, nylon resins, phenol resins, polyurethane resins, urea resins, melamine resins, polyester resins, polycarbonate resins, styrene resins such as styrene, polystyrene, polystyrene-isoprene copolymers and styrene vinylbenzene, acrylic resins such as vinylidene chloride acrylic, acrylic urethane and ethylene acrylic, polyethylene resins, formaldehyde resins such as benzoguanamine formaldehyde and melamine formaldehyde, polymethyl methacrylate resins, and vinyl chloride resins. In the present invention, each of these fillers may be used alone or in combination with two or more. When a plurality of fillers are used, the manner in which inorganic and organic fillers are combined together is not particularly limited. Also, these fillers are, for example, in the forms of spheres, particles, plates and needles. The amount of the filler(s) contained in the gas barrier layer is preferably 5% by volume to 50% by volume as a volume fraction.

Also, a lubricant may be added into each of the reversible thermosensitive recording layer, the close contact layer and the gas barrier layer. Examples of the lubricant include synthetic waxes such as ester waxes, paraffin waxes and polyethylene waxes; vegetable waxes such as hydrogenated castor waxes; animal waxes such as hardened tallow; higher alcohols such as stearyl alcohol and behenyl alcohol; higher fatty acids such as margaric acid, lauric acid, myristic acid, palmitic acid, stearic acid and behenic acid; higher fatty acid esters such as sorbitan fatty acid ester; and amides such as stearic acid amide, oleic acid amide, lauric acid amide, ethylenebis-stearic acid amide, methylenebis-stearic acid amide and methylol stearic acid amide. The amount of the lubricant contained in each layer is preferably 0.1% to 95%, more preferably 1% to 75%, as a volume fraction.

[Undercoat Layer]

In the reversible thermosensitive recording material of the present invention, besides the reversible thermosensitive recording layer, the close contact layer and the gas barrier layer, it is possible to provide an undercoat layer between the reversible thermosensitive recording layer and the support. In this case, it is desirable that the undercoat layer contain hollow particles for the purpose of improving color-developing sensitivity and color-erasing sensitivity. The hollow particles are not particularly limited as long as they have a hollowness of 70% or more, and known hollow particles may be used therefor. However, as hollow particles increase in hollowness, a wall material of the hollow particles becomes thinner, in which case the wall material decreases in strength against pressure, etc. and thus easily gets broken. Meanwhile, when an attempt is made to increase the strength of a wall material by simply hardening it, the wall material tends to become brittle and thus easily gets broken by bending. Therefore, a favorable balance between hardness and flexibility is required for the wall material of the hollow particles; suitable examples for wall materials having both hardness and flexibility include acrylonitrile resins and methacrylonitrile resins. Additionally, specific examples of hollow particles which can be suitably used in the present invention are described in JP-A No. 2005-199704 already applied by the present inventors.

[Protective Layer]

It is desirable to provide a protective layer on the outermost surface of a reversible thermosensitive recording medium, in other words outside the gas barrier layer. The protective layer is desirably provided on the outer surface of the gas barrier layer so as to prevent deformation of the surfaces of the gas barrier layer and the thermosensitive recording layer and creation of a so-called dent, caused by the heat and pressure of a thermal head when printing is carried out using the thermal head for recording onto a reversible thermosensitive recording material. It is desirable that the protective layer also have a function of protecting the surface of the reversible thermosensitive recording material from mechanical stress, moisture, etc. Additionally, it is desirable that a suitable material be selected therefor in terms of adhesiveness to the gas barrier layer, light permeability, weatherability, etc.

Examples of the resin forming the protective layer include water-soluble resins such as diacetone-modified polyvinyl alcohol, acetoacetyl-modified polyvinyl alcohol water-soluble resins, polyvinyl alcohol, cellulose derivatives, starch and derivatives thereof, carboxyl group-modified polyvinyl alcohol, polyacrylic acid and derivatives thereof, styrene-acrylic acid copolymers and derivatives thereof, poly(meth) acrylamide and derivatives thereof, styrene-acrylic acrylate-amide copolymers, amino group-modified polyvinyl alcohol, epoxy-modified polyvinyl alcohol, polyethyleneimine, aqueous polyesters, aqueous polyurethanes, and isobutylene-maleic anhydride copolymers and derivatives thereof; and polyesters, polyurethanes, acrylic acid ester polymers/copolymers, styrene-acrylic copolymers, epoxy resins, polyvinyl acetate, polyvinylidene chloride, polyvinyl chloride, and derivatives thereof. Among these, diacetone-modified polyvinyl alcohol and acetoacetyl-modified polyvinyl alcohol water-soluble resins are preferable. Further, it is desirable that the protective layer contain a hydrazide compound. Besides, cross-linked resins such as UV-curable resins and electron beam-curable resins are applicable.

Generally, a protective layer is provided on the surface of a thermosensitive recording material to protect an image from substances such as a plasticizer and oil. Use of diacetone-modified polyvinyl alcohol as a component of this protective layer makes it possible to improve the protective layer's heat resistance and resistance to adhesion of a head to the thermosensitive recording material at the time of printing. Further, addition of a hydrazide compound as a water resistant additive into the protective layer makes it possible to accelerate cross-linking reaction of the diacetone-modified polyvinyl alcohol and also improve its resistance to peeling by water.

Meanwhile, as filler(s) added into the protective layer, filler(s) similar to the one(s) used in the thermosensitive recording layer may, for example, be used, with aluminum hydroxide and silica being particularly useful. It is appropriate that the filler(s) added into the protective layer occupy 30% by mass to 80% by mass, preferably 40% by mass to 70% by mass, of the whole of the protective layer. The amount of the protective layer attached is preferably 3.0 g/m$^2$ or less, which enables smooth transmission of heat to the thermosensitive recording layer situated under the protective layer.

To form the protective layer, it is advisable that any of the materials be dissolved in a solvent or melted, then applied onto the surface of the gas barrier layer, and dried and solidified. The thickness of the protective layer in the present invention varies according to the type of material; however, it is preferably in the range of 0.1 μm to 5 μm. When the thickness is so small as to be outside this range, it is not favorable because the protective layer does not fully function as a protective layer in many cases. When the thickness is so large as to be outside this range, it is not favorable because the thermosensitive recording layer decreases in heat sensitivity as a thermosensitive recording material.

[Form of Reversible Thermosensitive Recording Medium]

The reversible thermosensitive recording material of the present invention may be affixed to another medium, with an adhesive layer or the like being placed in between. Alternatively, a back coat layer may be provided on one surface of a support made of PET film or the like; on the surface of the support opposite the back coat layer, there may be provided a release layer used for a thermal transfer ribbon, a reversible thermosensitive recording layer on the release layer, and a resin layer on the surface, capable of transferring images and the like onto paper, resin film, PET film, etc.; and images and the like may be thus transferred using a thermal transfer printer. The reversible thermosensitive recording material of the present invention may be processed into the form of a sheet or a card, which may have an arbitrary shape; also, the front and back surfaces of the reversible thermosensitive recording material may be printed. A reversible thermosensitive recording material processed into the form of a card can be used as a magnetic card or an IC card by incorporating a magnetic layer or an IC chip. Additionally, as to the reversible thermosensitive recording material of the present invention, both surfaces thereof may be made of a reversible thermosensitive recording material; alternatively, an irreversible thermosensitive recording layer may be used together with a reversible thermosensitive recording layer, in which case these recording layers may be the same or different in tone of developed color.

The reversible thermosensitive recording material of the present invention is specifically explained by means of the following Embodiments. It should be noted that the present invention is not confined to these Embodiments.

Embodiment 1

The structure of a reversible thermosensitive recording material (1) according to Embodiment 1 of the present invention is shown in FIG. 1. FIG. 1 is a partial cross-sectional view of the reversible thermosensitive recording material (1) of the present invention. In this reversible thermosensitive recording material (1), a thermosensitive recording layer 3 and a gas barrier layer 4 are laid over the surface of a sheet-like support 2 in this order. The support 2, the thermosensitive recording layer 3 and the gas barrier layer 4 denote those already described in detail, or the like.

As to the thermosensitive recording layer 3, the lower surface thereof is in contact with the support 2 having adequate gas barrier properties, while the upper surface thereof is covered with the gas barrier layer 4, and thus both surfaces thereof are prevented from directly coming into contact with the air. In principle, a reversible thermosensitive recording material only requires a layer formed of a thermosensitive recording material capable of repeating color development and color erasure as described above. However, a color former and a developer used in the thermosensitive recording layer are easily affected by light, and are liable to induce a radical reaction with oxygen especially when activated by light. When a radical reaction is induced, the thermosensitive recording layer, which has been developing color, may lose the color or may fade; also, the thermosensitive recording layer, which has been in a colorless state, may develop color, for example, in such a manner as to become yellow. The gas barrier layer is for preventing oxygen in the air from entering into the thermosensitive recording layer. Additionally, since the support 2 is generally a thick sheet or the like, it has an adequate oxygen-insulating function. When the support 2 does not have an oxygen-insulating function, the support 2 side may also be covered with the gas barrier layer 4.

Embodiment 2

Figure 2:
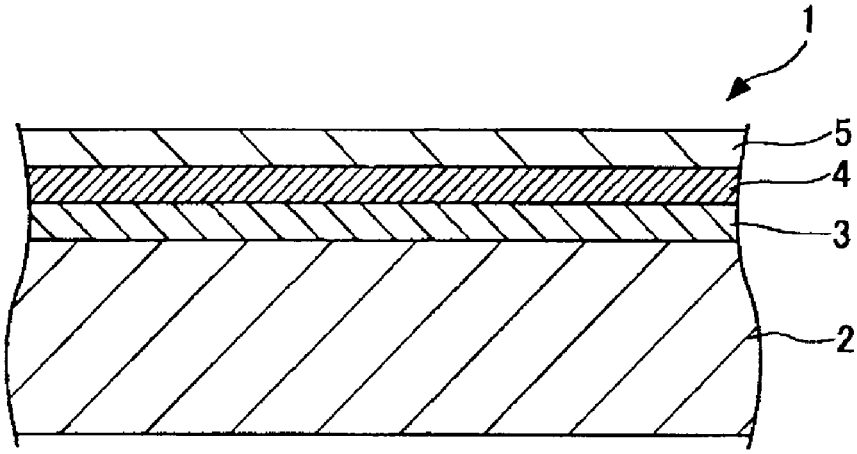
FIG. 2 is a cross-sectional view of a reversible thermosensitive recording material (2) of the present invention.

In a reversible thermosensitive recording material (2) according to Embodiment 2 of the present invention, the gas barrier layer surface of the reversible thermosensitive recording material (1) is covered with a protective layer. FIG. 2 is a partial cross-sectional view of the reversible thermosensitive recording material (2). In the laminated structure of the reversible thermosensitive recording material (2), a protective layer 5 is laid on the surface of the gas barrier layer 4 of the reversible thermosensitive recording material (1). When printing is carried out using a thermal head so as to record an image, etc. on the reversible thermosensitive recording material (1) without the protective layer 5, the surfaces of the gas barrier layer 4 and the thermosensitive recording layer 3 may be caused to deform by the heat and pressure of the thermal head, and a so-called dent may be created. To avoid this, it is desirable to provide the protective layer 5 on the surface. As already explained, it is desirable that the protective layer 5 also have a function of protecting the surface of the reversible thermosensitive recording material from mechanical stress, moisture, etc. Additionally, it is desirable that a suitable material be selected therefor in terms of adhesiveness to the gas barrier layer 4, light permeability, weatherability, etc.

Embodiment 3

Figure 3:
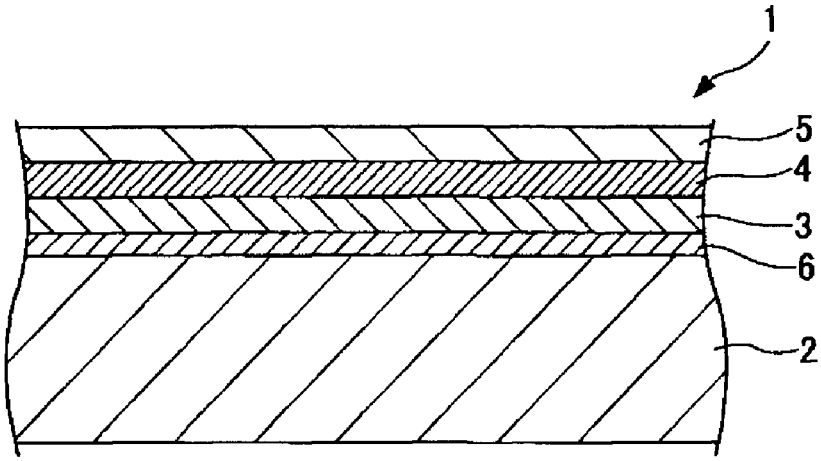
FIG. 3 is a cross-sectional view of a reversible thermosensitive recording material (3) of the present invention.

FIG. 3 shows a reversible thermosensitive recording material (3) according to Embodiment 3 of the present invention. In the reversible thermosensitive recording material (3) shown in FIG. 3, an undercoat layer 6 having high heat-insulating properties is provided between the thermosensitive recording layer 3 and the support 2 of the reversible thermosensitive recording material (2) shown in FIG. 2.

When heat is applied to the thermosensitive recording layer 3 so as to melt a color former and a developer, the undercoat layer 6 in the reversible thermosensitive recording material (3) is capable of preventing transmission of heat to the support 2 side, which enhances the heating efficiency of the thermosensitive recording layer 3, and also reducing an adverse effect caused by a rise in the temperature of the support 2. When the heating efficiency of the thermosensitive recording layer 3 is enhanced, the amount of heat needed to melt the color former and the developer can be reduced, and the amount of time spent in melting them can be reduced as well; therefore, color development and color erasure are made possible in a short period of time with a small heating head or a small heating roller. Also, unless the support 2 becomes high in temperature, the material therefor can be selected from a wider range of materials, and electronic components such as a magnetic recording material and an IC, to which the support is to be mounted, do not need to withstand high temperatures. Further, even if the support 2 side is made high in temperature when the reversible thermosensitive recording material is produced or used, it is possible to lessen the effect of heat on the thermosensitive recording layer 3 side.

The undercoat layer 6 is preferably formed of a material which has favorable adhesiveness to the support 2 and the thermosensitive recording layer 3. Also, the undercoat layer 6 is preferably a foamed layer because its heat-insulating effect can be enhanced. When the foamed layer is formed, as in the case of a urethane-based material, an undercoat layer precursor may be formed on the support 2, and this undercoat precursor may be foamed to serve as the undercoat layer 6. Additionally, a binder resin, inorganic and organic hollow particles such as foamed beads, and the like, which are undercoat layer raw materials, may be mixed together to form a heat-insulating layer 6 on the support 2.

As the hollow particles, fine hollow particles which have thermoplastic resin shells containing air and other gasses therein can be used, and their average particle diameter is preferably 0.4 μm to 10 μm. Hollow particles which are smaller than 0.4 μm in average particle diameter (particle outer diameter) present such a production-related problem that there is difficulty in making these hollow particles have a desired hollowness. Hollow particles which are larger than 10 μm in average particle diameter make it easier to form scratch-like streaks when applied over the support, and so the surface of the thermosensitive recording material has less smoothness after the application and drying; thus, the adhesiveness of the thermosensitive recording material to a thermal head degrades when an image is formed, and so there is a decrease in sensitivity improving effect. For the same reason, hollow particles whose particle diameters are in the above-mentioned range and whose particle diameter distribution is not wide are preferable. Further, these hollow particles preferably have a hollowness of 30% to 98%, more preferably 70% to 98%, even more preferably 90% to 98%. Note that the hollowness stated herein is the ratio between the inner diameter and the outer diameter of a hollow particle and is expressed by the following equation. As to the hollowness of the hollow particles, each particle observed in a micrograph or the like is measured for hollowness based upon its inner diameter and outer diameter with respect to the same direction, and the hollowness is calculated by the following equation.

$$\text{Hollowness (\%)}=[(\text{Inner diameter of hollow particle})/(\text{Outer diameter of hollow particle})]\times 100$$

The hollownesses of hollow particles dispersed in such a manner as to fill an area of at least 100 micrometers square are averaged based upon the number to yield the hollowness of the present invention. Provision of a layer containing hollow particles as an undercoat layer between a thermosensitive color-developing layer and the support makes it possible to obtain high heat-insulating properties, thereby improving the adhesiveness to a head and the color-developing sensitivity. Additionally, the method of measuring the particle diameters of hollow particles is based upon a laser method, as is the measuring method for the leuco dye.

As the material for the undercoat layer 6, a known resin may be additionally used. Examples thereof as hydrophobic resins include latexes such as styrene-butadiene copolymers and styrene-butadiene-acrylic ester copolymers; and emulsions such as vinyl acetate, vinyl acetate-acrylic acid copolymers, styrene-acrylic ester copolymers, acrylic ester resins and polyurethane resins. Examples thereof as water-soluble resins include modified polyvinyl alcohols such as completely saponified polyvinyl alcohol, carboxyl-modified polyvinyl alcohol, partially saponified polyvinyl alcohol, sulfonic acid-modified polyvinyl alcohol, silyl-modified polyvinyl alcohol, acetoacetyl-modified polyvinyl alcohol and diacetone-modified polyvinyl alcohol. In the undercoat layer 6, auxiliary additive components such as a filler, a thermally fusible component and a surfactant, which are commonly used in a thermosensitive recording material in accordance with the necessity, may also be used along with the hollow particles and the binder.

Further, it is also desirable to add pigment materials including those of white and black into the undercoat layer 6. When the undercoat layer 6 is given a color as a base color for the thermosensitive recording layer 3, a limitation on the color of the support 2 on the thermosensitive recording layer 3 side can be removed.

Embodiment 4

Figure 4:
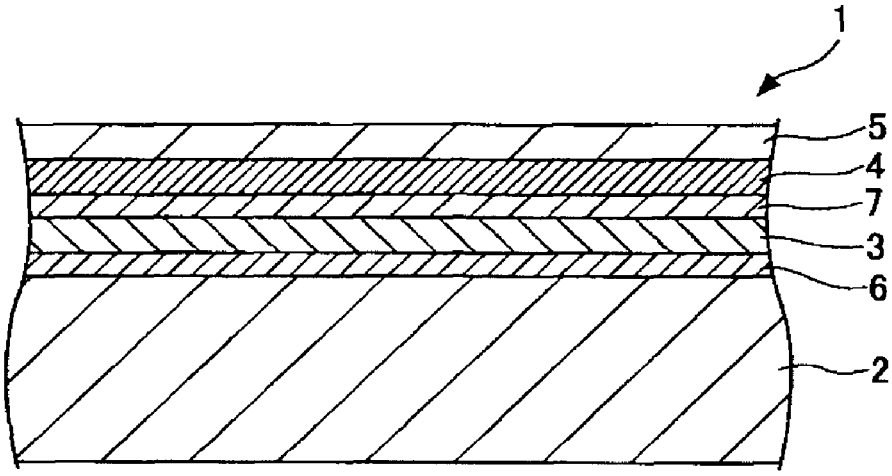
FIG. 4 is a cross-sectional view of a reversible thermosensitive recording material (4) of the present invention.

In a reversible thermosensitive recording material according to Embodiment 4 of the present invention, as shown in FIG. 4, a close contact layer and/or anchor coat layer 7 is preferably provided between a thermosensitive recording layer 3 and a gas barrier layer 4 for the purpose of improving adhesiveness between the thermosensitive recording layer 3 and the gas barrier layer 4 and thus further improving the capability of repeating color development and color erasure. The primary objective of the provision of this close contact layer and/or anchor coat layer 7 is to strengthen the bond between the thermosensitive recording layer 3 and the gas barrier layer 4, and the material of the close contact layer and/or anchor coat layer 7 is selected from materials which do not change the properties of a reversible thermosensitive recording material 1 at the time of coating or when used, stored, etc.

The method for forming the close contact layer and anchor coat layer 7 of the present invention is not particularly limited, and examples thereof include ordinary coating methods and laminating methods. The thickness of an adhesive layer is not particularly limited, with the range of 0.1 μm to 3 μm being preferable. When the thickness is so small as to be outside this range, it is not favorable because the adhesiveness of the adhesive layer is inadequate. When the thickness is so large as to be outside this range, it is not favorable because the heat sensitivity of the recording layer decreases.

[Formation of Image on Reversible Thermosensitive Recording Material]

The method for forming an image on the reversible thermosensitive recording material of the present invention may be selected from conventional methods for forming images on reversible thermosensitive recording materials based upon color development and color erasure, such as methods with a thermal pen, a thermal head, laser heating and the like, depending upon the purpose of use.

Figure 7:
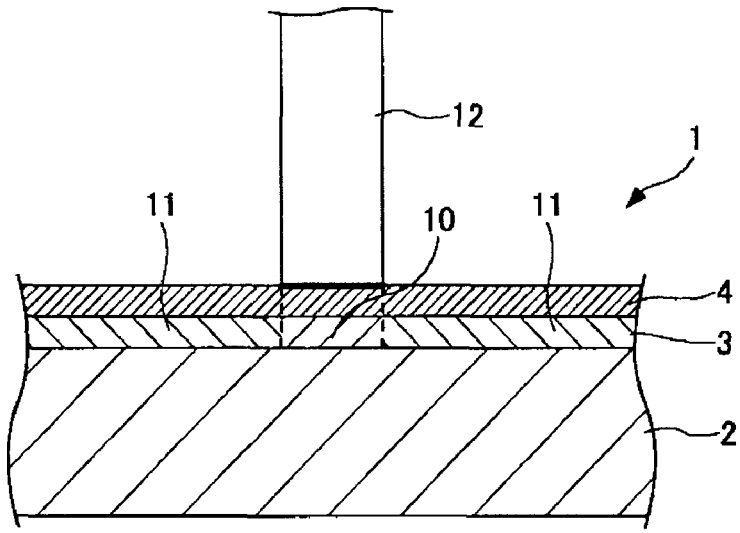
FIG. 7 is a diagram for explaining a method of developing color.
Figure 8:
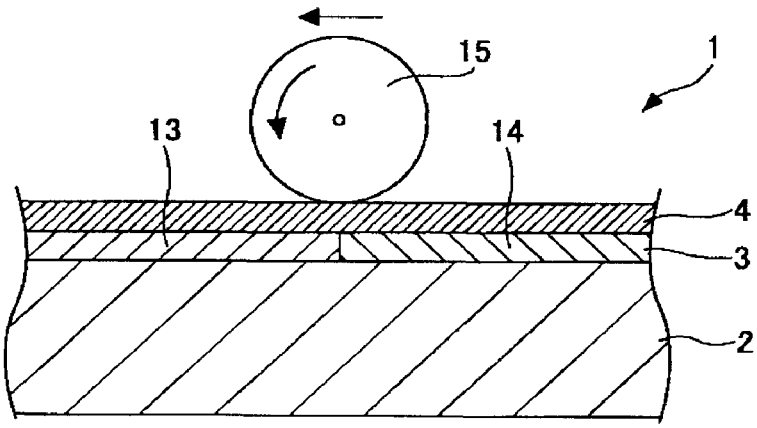
FIG. 8 is a diagram for explaining a method of erasing color.

FIGS. 7 and 8 show specific examples of a color-developing method and a color-erasing method for a reversible thermosensitive recording material, respectively. In the color-developing method, as shown in FIG. 7, a heating head 12 with a small area, exemplified by a thermal head of a dot printer, is pressed against the surface of a reversible thermosensitive recording material 1 in a colorless state. Since a reversible thermosensitive recording layer 3 and a barrier layer 4 are thin, a heated portion 10 of the reversible thermosensitive recording layer 3 is immediately heated, with its temperature reaching the melting point of a color former and the like constituting the reversible thermosensitive recording layer 3. Then the color former and a developer in the heated portion 10 of the reversible thermosensitive recording layer 3, which faces the heating head 12, melt and react with each other to develop color. On this occasion, once the heating head 12 is removed from the surface of the reversible thermosensitive recording material 1, the heated portion 10 of the reversible thermosensitive recording material 1 is immediately cooled because its area is small enough. Thus, the heated portion 10 is brought into a frozen state while developing color.

In the color-erasing method as well, as described above, the surface of a reversible thermosensitive recording material 1 is heated, first of all, so as to melt a heated area of a reversible thermosensitive recording layer 3. It should be noted that, as opposed to the above-mentioned case in which a small area is heated with a thermal head or the like, a relatively large area is preferably heated with a heating roller 15 as shown in FIG. 8, for example. Subsequently, when the heated area of the reversible thermosensitive recording layer 3 has melted, the heating roller 15 is rolled to heat another area. By doing so, the heated area which has once melted and developed color is cooled relatively slowly. In the meantime, a color former and a developer in the reversible thermosensitive recording layer 3 dissociate from each other, and each of them flocculates or crystallizes. Thus, the reversible thermosensitive recording layer 3 loses the color and is subsequently cooled to normal temperature, thereby being brought into a frozen state. In this color-erasing method, although a portion in a colorless state is also heated, color is normally erased by subjecting the whole of a reversible thermosensitive recording material to color erasure, and so such a method is useful. In FIG. 8, if the heating roller 15 rolls to the left in the arrow direction in this figure, an unheated portion 13 of the reversible thermosensitive recording layer 3, which has been developing color, is heated and thereby becomes a colorless area 14, as the heating roller 15 moves.

EXAMPLES

Examples

The present invention will be explained in further detail by means of Examples. Note that both the term "part" and the symbol "%" shown below are based upon mass.

(Preparation of Resin Solution)

<Preparation of Polyvinyl Alcohol Solution A>

Into 90 parts of purified water, 10 parts of a carboxy-modified polyvinyl alcohol resin (trade name: GOHSENOL T-350, produced by The Nippon Synthetic Chemical Industry Co., Ltd.; hereinafter otherwise referred to as "PVOH") were added, then the mixture was heated to 90° C. with agitation, and a transparent polyvinyl alcohol solution A (PVOH solution A) having a solid content concentration of 10% was thus obtained.

<Preparation of Ethylene-Vinyl Alcohol Copolymer Solution A>

Into 60 parts of a mixed solvent containing 50% of purified water and 50% of isopropyl alcohol (IPA), 30 parts of an ethylene-vinyl alcohol copolymer (trade name: SOARNOL D-2908, produced by The Nippon Synthetic Chemical Industry Co., Ltd.; hereinafter otherwise referred to as "EVOH") were added, 10 parts of a hydrogen peroxide solution having a concentration of 30% were also added, then the mixture was heated to 80° C. with agitation and subjected to reaction for 2 hr. Thereafter, the mixture was cooled, catalase was added such that the concentration of the mixture became 3,000 ppm, residual hydrogen peroxide was removed, and a substantially transparent ethylene-vinyl alcohol copolymer solution A (EVOH solution A) having a concentration of 30% was thus obtained.

(Preparation of Inorganic Layered Compound Dispersion Liquid)

<Preparation of Inorganic Layered Compound Dispersion Liquid A>

Into 95 parts of purified water, 5 parts of a natural montmorillonite product (trade name: KUNIPIA F, produced by Kunimine Industries Co., Ltd.), which is an inorganic layered compound, were added with agitation, then the mixture was sufficiently dispersed using a high-speed agitator. Thereafter, the mixture was kept warm at 40° C. for 1 day, and an inorganic layered compound dispersion liquid A having a solid content of 5% was thus obtained.

<Preparation of Inorganic Layered Compound Dispersion Liquid B>

An inorganic layered compound dispersion liquid B was obtained in a manner similar to the process of obtaining the inorganic layered compound dispersion liquid A, except that 1 part of magnesium hydroxide was also added.

<Preparation of Inorganic Layered Compound Dispersion Liquid C>

An inorganic layered compound dispersion liquid C was obtained in a manner similar to the process of obtaining the inorganic layered compound dispersion liquid A, except that the natural montmorillonite product was changed to a synthetic mica product (trade name: SOMASHIF ME100, produced by CO-OP Chemical Co., Ltd.).

(Preparation of Gas Barrier Resin Mixed Solution)

<Preparation of PVOH Gas Barrier Resin Mixed Solution 1>

Into 40 parts of purified water, 20 parts of a PVOH solution A were added, and the mixture was sufficiently agitated and mixed. Further, while this mixture was being agitated at high speed, 40 parts of the inorganic layered compound dispersion liquid A were added. Into 100 parts of this mixed solution, 3 parts of a cation-exchange resin were added, then the ingredients were agitated for 1 hr at such an agitation rate as did not cause the cation-exchange resin to fracture, and cations were thus removed; thereafter, only the cation-exchange resin was filtered out using a strainer. The mixed solution finally obtained by the process was dispersed at a pressure of 50 MPa using a high-pressure disperser and then filtered with a 300-mesh filter, and a gas barrier resin mixed solution 1 (PVOH/Inorganic layered compound=50/50; hereinafter referred to as "PV1") having a solid content of 5% was thus obtained.

<Preparation of PVOH Gas Barrier Resin Mixed Solution 2>

A gas barrier resin mixed solution 2 (PVOH/Inorganic layered compound=80/20; hereinafter referred to as "PV2") was obtained in a manner similar to the process of obtaining the PV1, except that the amount of the PVOH solution A was changed to 40 parts and the amount of the inorganic layered compound dispersion liquid A was changed to 20 parts.

<Preparation of PVOH Gas Barrier Resin Mixed Solution 3>

A gas barrier resin mixed solution 3 (PVOH/Inorganic layered compound=94/6; hereinafter referred to as "PV3") was obtained in a manner similar to the process of obtaining the PV1, except that the amount of the PVOH solution A was changed to 53 parts and the amount of the inorganic layered compound dispersion liquid A was changed to 7 parts.

<Preparation of PVOH Gas Barrier Resin Mixed Solution 4>

A gas barrier resin mixed solution 4 (PVOH/Inorganic layered compound=50/50; hereinafter referred to as "PV4") was obtained in a manner similar to the process of obtaining the PV1, except that the inorganic layered compound dispersion liquid A was changed to the inorganic layered compound dispersion liquid B.

<Preparation of PVOH Gas Barrier Resin Mixed Solution 5>

A gas barrier resin mixed solution 5 (PVOH/Inorganic layered compound=80/20; hereinafter referred to as "PV5") was obtained in a manner similar to the process of obtaining the PV2, except that the inorganic layered compound dispersion liquid A was changed to the inorganic layered compound dispersion liquid B.

<Preparation of PVOH Gas Barrier Resin Mixed Solution 6>

A gas barrier resin mixed solution 6 (PVOH/Inorganic layered compound=94/6; hereinafter referred to as "PV6") was obtained in a manner similar to the process of obtaining the PV3, except that the inorganic layered compound dispersion liquid A was changed to the inorganic layered compound dispersion liquid B.

<Preparation of PVOH Gas Barrier Resin Mixed Solution 7>

A gas barrier resin mixed solution 7 (PVOH/Inorganic layered compound=50/50; hereinafter referred to as "PV7") was obtained in a manner similar to the process of obtaining the PV1, except that the inorganic layered compound dispersion liquid A was changed to the inorganic layered compound dispersion liquid C.

<Preparation of PVOH Gas Barrier Resin Mixed Solution 8>

A gas barrier resin mixed solution 8 (PVOH/Inorganic layered compound=80/20; hereinafter referred to as "PV8") was obtained in a manner similar to the process of obtaining the PV2, except that the inorganic layered compound dispersion liquid A was changed to the inorganic layered compound dispersion liquid C.

<Preparation of PVOH Gas Barrier Resin Mixed Solution 9>

A gas barrier resin mixed solution 9 (PVOH/Inorganic layered compound=94/6; hereinafter referred to as "PV9") was obtained in a manner similar to the process of obtaining the PV3, except that the inorganic layered compound dispersion liquid A was changed to the inorganic layered compound dispersion liquid C.

<Preparation of EVOH Gas Barrier Resin Mixed Solution 1>

Into 60 parts of a mixed solvent of 50% of purified water and 50% of IPA, 2.1 parts of an EVOH solution A were added, and the mixture was sufficiently agitated and mixed. Further, while this mixture was being agitated at high speed, 37.9 parts of the inorganic layered compound dispersion liquid A were added. Into 100 parts of this mixed solution, 3 parts of a cation-exchange resin were added, then the ingredients were agitated for 1 hr at such an agitation rate as did not cause the cation-exchange resin to fracture, and cations were thus removed; thereafter, only the cation-exchange resin was filtered out using a strainer. The mixed solution finally obtained by the process was dispersed at a pressure of 50 MPa using a high-pressure disperser and then filtered with a 300-mesh filter, and a gas barrier resin mixed solution 1 (EVOH/Inorganic layered compound=25/75; hereinafter referred to as "EV1") having a solid content of 3% was thus obtained.

<Preparation of EVOH Gas Barrier Resin Mixed Solution 2>

A gas barrier resin mixed solution 2 (EVOH/Inorganic layered compound=40/60; hereinafter referred to as "EV2") was obtained in a manner similar to the process of obtaining the EV1, except that the amount of the EVOH solution A was changed to 4.0 parts and the amount of the inorganic layered compound dispersion liquid A was changed to 36.0 parts.

<Preparation of EVOH Gas Barrier Resin Mixed Solution 3>

A gas barrier resin mixed solution 3 (EVOH/Inorganic layered compound=80/20; hereinafter referred to as "EV3") was obtained in a manner similar to the process of obtaining the EV1, except that the amount of the EVOH solution A was changed to 16.0 parts and the amount of the inorganic layered compound dispersion liquid A was changed to 24.0 parts.

<Preparation of EVOH Gas Barrier Resin Mixed Solution 4>

A gas barrier resin mixed solution 4 (EVOH/Inorganic layered compound=99/1; hereinafter referred to as "EV4") was obtained in a manner similar to the process of obtaining the EV1, except that the amount of the EVOH solution A was changed to 37.7 parts and the amount of the inorganic layered compound dispersion liquid A was changed to 2.3 parts.

<Preparation of EVOH Gas Barrier Resin Mixed Solution 5>

A gas barrier resin mixed solution 5 (EVOH/Inorganic layered compound=99.8/0.2; hereinafter referred to as "EV5") was obtained in a manner similar to the process of obtaining the EV1, except that the amount of the EVOH solution A was changed to 39.5 parts and the amount of the inorganic layered compound dispersion liquid A was changed to 0.5 parts.

<Preparation of EVOH Gas Barrier Resin Mixed Solution 6>

A gas barrier resin mixed solution 6 (EVOH/Inorganic layered compound=25/75; hereinafter referred to as "EV6") was obtained in a manner similar to the process of obtaining the EV1, except that the inorganic layered compound dispersion liquid A was changed to the inorganic layered compound dispersion liquid B.

<Preparation of EVOH Gas Barrier Resin Mixed Solution 7>

A gas barrier resin mixed solution 7 (EVOH/Inorganic layered compound=40/60; hereinafter referred to as "EV7") was obtained in a manner similar to the process of obtaining the EV2, except that the inorganic layered compound dispersion liquid A was changed to the inorganic layered compound dispersion liquid B.

<Preparation of EVOH Gas Barrier Resin Mixed Solution 8>

A gas barrier resin mixed solution 8 (EVOH/Inorganic layered compound=80/20; hereinafter referred to as "EV8") was obtained in a manner similar to the process of obtaining the EV3, except that the inorganic layered compound dispersion liquid A was changed to the inorganic layered compound dispersion liquid B.

<Preparation of EVOH Gas Barrier Resin Mixed Solution 9>

A gas barrier resin mixed solution 9 (EVOH/Inorganic layered compound=99/1; hereinafter referred to as "EV9") was obtained in a manner similar to the process of obtaining the EV4, except that the inorganic layered compound dispersion liquid A was changed to the inorganic layered compound dispersion liquid B.

<Preparation of EVOH Gas Barrier Resin Mixed Solution 10>

A gas barrier resin mixed solution 10 (EVOH/Inorganic layered compound=99.8/0.2; hereinafter referred to as "EV10") was obtained in a manner similar to the process of obtaining the EV5, except that the inorganic layered compound dispersion liquid A was changed to the inorganic layered compound dispersion liquid B.

<Preparation of EVOH Gas Barrier Resin Mixed Solution 11>

A gas barrier resin mixed solution 11 (EVOH/Inorganic layered compound=25/75; hereinafter referred to as "EV11") was obtained in a manner similar to the process of obtaining the EV1, except that the inorganic layered compound dispersion liquid A was changed to the inorganic layered compound dispersion liquid C.

<Preparation of EVOH Gas Barrier Resin Mixed Solution 12>

A gas barrier resin mixed solution 12 (EVOH/Inorganic layered compound=40/60; hereinafter referred to as "EV12") was obtained in a manner similar to the process of obtaining the EV2, except that the inorganic layered compound dispersion liquid A was changed to the inorganic layered compound dispersion liquid C.

<Preparation of EVOH Gas Barrier Resin Mixed Solution 13>

A gas barrier resin mixed solution 13 (EVOH/Inorganic layered compound=80/20; hereinafter referred to as "EV13") was obtained in a manner similar to the process of obtaining the EV3, except that the inorganic layered compound dispersion liquid A was changed to the inorganic layered compound dispersion liquid C.

<Preparation of EVOH Gas Barrier Resin Mixed Solution 14>

A gas barrier resin mixed solution 14 (EVOH/Inorganic layered compound=99/1; hereinafter referred to as "EV14") was obtained in a manner similar to the process of obtaining the EV4, except that the inorganic layered compound dispersion liquid A was changed to the inorganic layered compound dispersion liquid C.

<Preparation of EVOH Gas Barrier Resin Mixed Solution 15>

A gas barrier resin mixed solution 15 (EVOH/Inorganic layered compound=99.8/0.2; hereinafter referred to as "EV15") was obtained in a manner similar to the process of obtaining the EV5, except that the inorganic layered compound dispersion liquid A was changed to the inorganic layered compound dispersion liquid C.

(Preparation of Anchor Coat Layer Coating Solution)

<Preparation of Anchor Coat Layer Coating Solution A>

Into 130 parts of ethyl acetate, 15 parts of an ester polyol resin (trade name: TAKELAC A-3210 (solid content concentration: 50%), produced by Mitsui Chemicals Polyurethanes, Inc.) and 5 parts of an isocyanate compound (trade name: TAKENATE A-3070 (solid content concentration: 75%), produced by Mitsui Chemicals Polyurethanes, Inc.) were mixed, and an anchor coat layer coating solution A having a total solid content concentration of 7.5% was thus obtained.

Example 1

| <Production of Undercoat Layer> | |
|---|---|
| Hollow particle dispersion liquid (solid content concentration: 30%) (trade name: NIPOL MH5055, produced by Zeon Corporation) | 30 parts |
| Modified SB latex (solid content concentration: 48%) (trade name: NIPOL LX407S, produced by Zeon Corporation) | 10 parts |

-continued

| <Production of Undercoat Layer> | |
|---|---|
| Completely saponified polyvinyl alcohol aqueous solution (solid content concentration: 16%) | 9 parts |
| Water | 50 parts |

A mixture composed of these ingredients was agitated and dispersed, and an undercoat layer coating solution was thus prepared. This undercoat layer coating solution was applied onto a support of a white PET film (produced by Teijin DuPont Films Japan Limited) having a thickness of approximately 188 μm, using a wire bar, and dried at 115° C. for 1 min, and an undercoat layer having a thickness of approximately 6.0 μm was thus provided.

| <Production of Reversible Thermosensitive Recording Layer> | |
|---|---|
| 2-anilino-3-methyl-6-diethylaminofluoran | 2 parts |
| Developer having the following structure | 8 parts |

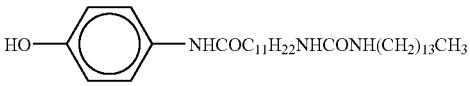

| | |
|---|---|
| Controlling agent having the following structure $C_{15}H_{31}CONHC_{16}H_{33}$ | 2 parts |
| 15% methyl ethyl ketone solution of acrylic polyol resin (hydroxyl value: 70, acid value: less than 1.0, molecular weight: 35,000, glass transition temperature: 52° C., hydroxyl monomer: 2-hydroxyethyl methacrylate) | 150 parts |
| CORONATE HL | 10 parts |

A composition composed of these ingredients was pulverized and dispersed using a ball mill, such that its average particle diameter became 0.1 μm to 3 μm. Using the dispersion liquid obtained, a reversible thermosensitive recording layer coating solution was prepared. This reversible thermosensitive recording layer coating solution was applied onto the undercoat layer, using a wire bar, and dried at 100° C. for 1 min, then warmed at 60° C. for 24 hr, and a reversible thermosensitive recording layer having a thickness of approximately 10.0 μm was thus provided.

| <Production of Close Contact Layer> | |
|---|---|
| Zinc oxide dispersion liquid (solid content concentration: 32.4%) (trade name: ZS-303T, produced by Sumitomo Osaka Cement Co., Ltd.) | 30 parts |
| 15% methyl ethyl ketone solution of acrylic polyol resin (hydroxyl value: 70, acid value: less than 1.0, molecular weight: 35,000, glass transition temperature: 52° C., hydroxyl monomer: 2-hydroxyethyl methacrylate) | 50 parts |
| CORONATE HL | 3.5 parts |

A composition composed of these ingredients was applied onto the reversible thermosensitive recording layer, using a wire bar, and dried at 100° C. for 1 min, then warmed at 60° C. for 24 hr, and a close contact layer having a thickness of approximately 3.0 μm was thus provided.

<Production of Gas Barrier Layer>

Into 10 parts of the PV 1, 0.3 parts of a silane coupling agent (trade name: SH-6062, produced by Dow Corning Toray Co., Ltd.) were added, then the mixture was agitated and mixed. Subsequently, the mixture was applied onto the close contact layer, using a wire bar, and dried at 100° C. for 1 min, then warmed at 50° C. for 24 hr, and a gas barrier layer having a thickness of approximately 1.0 μm was thus provided.

| <Production of Protective Layer> | |
|---|---|
| Urethane acrylate UV-curable resin (C7-157, produced by Dainippon Ink And Chemicals, Incorporated) | 15 parts |
| Ethyl acetate | 85 parts |

A mixture composed of these ingredients was sufficiently agitated, and a protective layer solution was thus prepared. This coating solution was applied onto the gas barrier layer, using a wire bar, and dried at 90° C. for 1 min, then hardened by being passed at a conveyance rate of 9 m/min under an ultraviolet lamp of 80 W/cm in irradiation energy, and a protective layer having a thickness of approximately 3 μm was thus provided. A reversible thermosensitive recording medium of the present invention was thereby produced.

Examples 2 to 9

Reversible thermosensitive recording media were produced similarly to the one in Example 1, except that the PV2 to the PV9 were used instead of the PV 1.

Example 10

A reversible thermosensitive recording medium was produced similarly to the one in Example 1, except that the pressure with which the inorganic layered compound was dispersed into the PVOH solution was changed to 200 MPa.

Example 11

A reversible thermosensitive recording medium was produced similarly to the one in Example 1, except that the pressure with which the inorganic layered compound was dispersed into the PVOH solution was changed to 0.5 MPa.

Comparative Example 1

A reversible thermosensitive recording medium was produced similarly to the one in Example 1, except that the PV 1 was removed and thus a gas barrier layer was not applied.

Comparative Example 2

A reversible thermosensitive recording medium was produced similarly to the one in Example 1, except that the PVOH solution A was used instead of the PV 1.

(Evaluation 1)

(Evaluation of Image Density, Background Density and Unerased Portion)

Each reversible thermosensitive recording medium produced was subjected to printing and erasure under the following conditions, using a thermosensitive printing simulator incorporating KSB320AA (resistance value: 1,206 ohms), which is an edge-type thermal head manufactured by Kyocera Corporation, and a ceramic heater (width: 4 mm), and the densities thereof were measured using RD-914, which is a Macbeth densitometer.

Evaluation condition: 5 in/s in printing speed; 8 dot/mm in vertical scanning density Image density: maximum density of an image when it was printed on a reversible thermosensitive recording medium, with the voltage of application energy being changed for every 1V Erasure density: minimum erasure density of a solid image when the solid image, formed on a reversible thermosensitive recording medium utilizing the application energy with which the maximum density had been obtained with respect to the above-mentioned image density, was erased with the temperature of the ceramic heater being changed for every 5° C.

The results concerning Evaluation 1 are shown in Table 1.

TABLE 1

| | Evaluation 1 | | | Evaluation 3 | |
|---|---|---|---|---|---|
| | Image density | Erasure density | Evaluation 2 Durability | Image density | Erasure density |
| Example 1 | 1.30 | 0.08 | C | 1.17 | 0.10 |
| Example 2 | 1.32 | 0.06 | B | 1.20 | 0.09 |
| Example 3 | 1.35 | 0.06 | A | 1.20 | 0.09 |
| Example 4 | 1.30 | 0.08 | C | 1.19 | 0.09 |
| Example 5 | 1.33 | 0.06 | B | 1.18 | 0.07 |
| Example 6 | 1.33 | 0.06 | A | 1.21 | 0.08 |
| Example 7 | 1.30 | 0.08 | C | 1.22 | 0.09 |
| Example 8 | 1.32 | 0.06 | B | 1.21 | 0.08 |
| Example 9 | 1.33 | 0.06 | A | 1.24 | 0.07 |
| Example 10 | 1.30 | 0.06 | C | 1.12 | 0.14 |
| Example 11 | 1.14 | 0.06 | C | 1.01 | 0.07 |
| Comparative Example 1 | 1.40 | 0.06 | A | 0.34 | 0.33 |
| Comparative Example 2 | 1.35 | 0.06 | C | 0.61 | 0.28 |

(Evaluation 2)

(Evaluation of Durability Against Repeated Use)

Each reversible thermosensitive recording medium produced was repeatedly subjected to printing and erasure 100 times, using KU-R2800, which is a card printer manufactured by Panasonic Communications Co., Ltd. After it had been repeatedly subjected to printing and erasure 100 times, a card surface of each reversible thermosensitive recording material was visually observed and then evaluated with the following levels. The results concerning Evaluation 2 are shown in Table 1.

Note that the letters A, B, C and D used in the evaluations denote the following levels.

A: such a level that the color-developed state of an image portion and the colorless state of an erased portion were favorable, and detachment of a coating film was not observed B: such a level that although the color-developed state of an image portion and the colorless state of an erased portion were favorable, detachment of a coating film was slightly observed C: such a level that a color-developing image was concealed and slightly whitened, and detachment of a coating film was observed D: such a level that detachment of a coating film was so noticeable, and thus evaluation of durability against repeated use could not continue (Evaluation 3)

(Evaluation of Light Resistance)

Every reversible thermosensitive recording medium produced was provided with a color-developing image as in Evaluation 1 and exposed to xenon (illuminance: 130,000 Lx, time: 144 hr, temperature 30° C., humidity: 85% (RH); artificial sunlight irradiation apparatus manufactured by Seric Ltd.). The image density and the erasure density after the exposure were measured as in Evaluation 1. The results concerning Evaluation 3 are shown in Table 1.

Judging from the results shown in Table 1, it was found that the evaluation results of Examples were, on the whole, superior to those of Comparative Examples. As note was taken of the differences among the production conditions of the reversible thermosensitive recording materials of Examples, it was found from Evaluation 3 that the reversible thermosensitive recording material of the present invention provided with a PVOH gas barrier layer had superior light resistance. In Evaluation 2 concerning durability against repeated use, Examples 1, 4 and 7 in which inorganic layered compounds were contained in larger amounts (gas barrier resin/inorganic layered compound=50/50) were ranked C and detachment of coating films was slightly observed; however, as the amounts of inorganic layered compounds decreased, better evaluation results were obtained. Also, it was found that the reversible thermosensitive recording materials of the present invention in which inorganic layered compounds were dispersed were far better in light resistance under high-humidity conditions than the reversible thermosensitive recording material of Comparative Example 2 in which a layer formed only of a PVOH resin was applied.

Examples 10 and 11 are examples in which the dispersion pressure conditions of the gas barrier resin mixed solution of the present invention were changed; it was found that the initial image density (Evaluation 1) and light resistance (Evaluation 3) were affected by dispersion conditions as well. Specifically, the following were observed: in Example 11 in which the amount of dispersion pressure was small, since whitening which stemmed from the inorganic layered compound occurred slightly, and concealment of the image occurred slightly as a result, the initial color-developing density was affected; and in Example 10 in which the amount of dispersion pressure was large, since pulverization of the inorganic layered compound proceeded and thus there was a reduction in baffle plate function against passage of gas, a slightly larger unerased portion (Evaluation 3) was left after light exposure. It is inferred that as to preparation of the gas barrier resin mixed solution of the present invention, further effectiveness can be exhibited by means of appropriate dispersion pressure.

Example 12

In the step of producing the reversible thermosensitive recording material of Example 1, when the close contact layer had been formed on the reversible thermosensitive recording layer, the following gas barrier layer and protective layer were provided on the close contact layer.

<Production of Gas Barrier Layer>

The EV 1 was applied onto the close contact layer, using a wire bar, and dried at 100° C. for 1 min, then warmed at 50° C. for 24 hr, and a gas barrier layer having a thickness of approximately 1.0 μm was thus provided.

| <Production of Protective Layer> | |
|---|---|
| Urethane acrylate UV-curable resin (C7-157 produced by Dainippon Ink and Chemicals, Incorporated) | 15 parts |
| Ethyl acetate | 85 parts |

A mixture composed of these ingredients was sufficiently agitated, and a protective layer solution was prepared. This solution was applied onto the gas barrier layer, using a wire bar, and dried at 90° C. for 1 min, then hardened by being passed at a conveyance rate of 9 m/min under an ultraviolet lamp of 80 W/cm in irradiation energy, and a protective layer having a thickness of approximately 3 μm was thus provided. A reversible thermosensitive recording medium of the present invention was thereby produced.

Examples 13 to 26

Reversible thermosensitive recording media were produced similarly to the one in Example 12, except that the EV2 to the EV15 were used instead of the EV1.

Example 27

In Example 12, instead of the exclusive use of the EV1, 0.1 parts of a carbodiimide compound (trade name: CARBODILITE V-04, produced by Nisshinbo Industries, Inc.) were added to 10 parts of the EV1, then the mixture was agitated and mixed to produce a mixed solution. Subsequently, this mixed solution was applied onto a close contact layer, using a wire bar, and dried at 100° C. for 1 min, then warmed at 50° C. for 24 hr, and a gas barrier layer having a thickness of approximately 1.0 μm was thus provided. A reversible thermosensitive recording medium was produced, with the steps other than the gas barrier layer forming step being similar to those in Example 12.

Comparative Example 3

A reversible thermosensitive recording medium was produced similarly to the one in Example 12, except that a gas barrier layer was not formed.

Comparative Example 4

A reversible thermosensitive recording medium was produced similarly to the one in Example 12, except that the EVOH solution A was used instead of the EV1.

The results of Evaluations 1 to 3 concerning Examples 12 to 27 and Comparative Examples 3 and 4 are shown in Table 2.

TABLE 2

| | Evaluation 1 | | | Evaluation 3 | |
|---|---|---|---|---|---|
| | Image density | Erasure density | Evaluation 2 Durability | Image density | Erasure density |
| Example 12 | 1.30 | 0.07 | C | 1.15 | 0.15 |
| Example 13 | 1.31 | 0.06 | C | 1.16 | 0.12 |
| Example 14 | 1.32 | 0.07 | B | 1.28 | 0.08 |
| Example 15 | 1.35 | 0.07 | B | 1.25 | 0.08 |
| Example 16 | 1.35 | 0.06 | A | 1.03 | 0.13 |
| Example 17 | 1.28 | 0.06 | C | 1.14 | 0.09 |
| Example 18 | 1.30 | 0.07 | C | 1.14 | 0.09 |
| Example 19 | 1.32 | 0.06 | B | 1.27 | 0.08 |
| Example 20 | 1.33 | 0.06 | B | 1.28 | 0.07 |
| Example 21 | 1.34 | 0.06 | A | 1.04 | 0.12 |
| Example 22 | 1.28 | 0.06 | C | 1.09 | 0.08 |
| Example 23 | 1.29 | 0.06 | C | 1.11 | 0.07 |
| Example 24 | 1.30 | 0.06 | B | 1.25 | 0.07 |
| Example 25 | 1.31 | 0.06 | B | 1.20 | 0.07 |
| Example 26 | 1.33 | 0.06 | A | 1.05 | 0.12 |
| Example 27 | 1.30 | 0.07 | B | 1.16 | 0.13 |
| Comparative Example 3 | 1.38 | 0.06 | A | 0.34 | 0.33 |
| Comparative Example 4 | 1.35 | 0.06 | B | 0.47 | 0.30 |

Judging from the results of Evaluation 3, as shown in Table 2, it was found that the reversible thermosensitive recording materials of the present invention provided with EVOH gas barrier layers had superior light resistance. In Evaluation 2 concerning durability against repeated use, detachment of coating films was slightly observed with respect to Examples 12, 17 and 22 in which inorganic layered compounds were contained in larger amounts (EVOH/inorganic layered compound=25/75); however, as the amounts of inorganic layered compounds decreased, better evaluation results were obtained. Also, it was found that the reversible thermosensitive recording materials of the present invention in which inorganic layered compounds were dispersed were far better in light resistance under high-humidity conditions than the reversible thermosensitive recording material of Comparative Example 4 in which a layer formed only of an EVOH resin was applied.

Examples 28 to 43

The following anchor coat layers were provided on close contact layers produced in a process similar to that in Example 12.

<Production of Anchor Coat Layer>

An anchor coat layer coating agent A was applied onto the close contact layers, using a wire bar, and dried at 80° C. for 30 sec, and anchor coat layers each having a thickness of approximately 0.3 μm were thus provided.

Reversible thermosensitive recording media were produced in which gas barrier layers and protective layers, formed in the same manner as those in Examples 12 to 27, were provided on the anchor coat layers, and these media served as reversible thermosensitive recording media of Examples 28 to 43 respectively.

The results of Evaluations 1 to 3 concerning Examples 28 to 43 are shown in Table 3.

TABLE 3

| | Evaluation 1 | | | Evaluation 3 | |
|---|---|---|---|---|---|
| | Image density | Erasure density | Evaluation 2 Durability | Image density | Erasure density |
| Example 28 | 1.30 | 0.07 | B | 1.15 | 0.15 |
| Example 29 | 1.31 | 0.06 | B | 1.16 | 0.12 |
| Example 30 | 1.32 | 0.07 | A | 1.28 | 0.08 |
| Example 31 | 1.35 | 0.07 | A | 1.25 | 0.08 |
| Example 32 | 1.35 | 0.06 | A | 1.03 | 0.13 |
| Example 33 | 1.28 | 0.06 | B | 1.14 | 0.09 |
| Example 34 | 1.30 | 0.07 | B | 1.14 | 0.09 |
| Example 35 | 1.32 | 0.06 | A | 1.27 | 0.08 |
| Example 36 | 1.33 | 0.06 | A | 1.28 | 0.07 |
| Example 37 | 1.34 | 0.06 | A | 1.04 | 0.12 |
| Example 38 | 1.28 | 0.06 | B | 1.09 | 0.08 |
| Example 39 | 1.29 | 0.06 | B | 1.11 | 0.07 |
| Example 40 | 1.30 | 0.06 | A | 1.25 | 0.07 |
| Example 41 | 1.31 | 0.06 | A | 1.20 | 0.07 |
| Example 42 | 1.33 | 0.06 | A | 1.05 | 0.12 |
| Example 43 | 1.30 | 0.07 | A | 1.14 | 0.13 |

Judging from the evaluation results shown in Table 3, it was found that although detachment of coating films was slightly observed in the evaluation of durability against repeated use (Evaluation 2) with respect to reversible thermosensitive recording media in which inorganic layered compounds were dispersed in large amounts for gas barrier layers, detachment of coating films was able to be reduced by providing the anchor coat layers.

With the detailed explanations of the present invention given by Examples above, it is obvious that the reversible thermosensitive recording material of the present invention is excellent in light resistance and durability against repeated use as well as in color development and color erasure of an initial image.

What is claimed is:

1. A reversible thermosensitive recording material comprising:

a support, a reversible thermosensitive recording layer, and a gas barrier layer, the reversible thermosensitive recording layer and gas barrier layer being laid over the support, wherein the reversible thermosensitive recording layer is formed of a reversible thermosensitive composition containing a mixture of an electron-accepting compound and an electron-donating color-forming compound whose color-developed state varies depending upon at least one of a heating temperature and a cooling rate after heating, the gas barrier layer contains an inorganic layered compound and a gas barrier resin which is at least one selected from the group consisting of polyvinyl alcohol polymers and ethylene-vinyl alcohol copolymers, and the inorganic layered compound is at least one selected from the group consisting of antigorite minerals, smectite minerals and vermiculite minerals.

2. The reversible thermosensitive recording material according to claim 1, wherein the inorganic layered compound is a synthetic product of a swelling clay mineral.

3. The reversible thermosensitive recording material according to claim 1, wherein the mass ratio of the gas barrier resin to the inorganic layered compound in the gas barrier layer is in the range of 30:70 to 99:1.

4. The reversible thermosensitive recording material according to claim 1, wherein the length and the width of the inorganic layered compound are in the range of 5 nm to 5,000 nm each, and the thickness of the inorganic layered compound is 1/10 to 1/10,000 of the length.

5. The reversible thermosensitive recording material according to claim 1, wherein the inorganic layered compound comprises an ion of at least one selected from the group consisting of alkali metals and alkaline earth metals.

6. The reversible thermosensitive recording material according to claim 1, wherein the ethylene-vinyl alcohol copolymer contains an ethylene component by 20 mol % to 60 mol %, the saponification degree of a vinyl acetate component of the ethylene-vinyl alcohol copolymer is 95 mol % or more, and the ethylene-vinyl alcohol copolymer is insoluble in water.

7. The reversible thermosensitive recording material according to claim 1, wherein the gas barrier layer further comprises an adhesiveness improver for improving its adhesiveness to other layers adjacent thereto.

8. The reversible thermosensitive recording material according to claim 7, wherein the adhesiveness improver contains at least one selected from the group consisting of silane coupling agents, isocyanate compounds, aziridine compounds and carbodiimide compounds.

9. The reversible thermosensitive recording material according to claim 1, wherein the gas barrier layer is a layer obtained by mixing the inorganic layered compound into a solution of the gas barrier resin and dispersing the inorganic layered compound under a pressure of 1 MPa to 100 MPa to prepare a resin composition, and forming the resin composition into a film and drying the resin composition.

10. The reversible thermosensitive recording material according to claim 1, wherein the gas barrier layer has a thickness of 0.1 μm to 5.0 μm.

11. The reversible thermosensitive recording material according to claim 1, further comprising at least one intermediate layer between the reversible thermosensitive recording layer and the gas barrier layer so as to improve adhesiveness between the reversible thermosensitive recording layer and the gas barrier layer.

12. The reversible thermosensitive recording material according to claim 11, wherein the intermediate layer contains an ester polyol resin.

13. The reversible thermosensitive recording material according to claim 11, further comprising at least one intermediate layer between the reversible thermosensitive recording layer and the gas barrier layer, wherein the intermediate layer is configured to include at least one of a close contact layer and an anchor coat layer, to improve adhesiveness between the reversible thermosensitive recording layer and the gas barrier layer.

14. The reversible thermosensitive recording material according to claim 11, further comprising at least one intermediate layer between the reversible thermosensitive recording layer and the gas barrier layer, wherein the intermediate layer contains an isocyanate-based, urethane-based or acrylic-based adhesive, to improve adhesiveness between the reversible thermosensitive recording layer and the gas barrier layer.

15. The reversible thermosensitive recording material according to claim 11, further comprising at least one intermediate layer between the reversible thermosensitive recording layer and the gas barrier layer, wherein the intermediate layer contains a titanium-based, isocyanate-based, imine-based or polybutadiene-based anchor coat agent.

16. The reversible thermosensitive recording material according to claim 1, further comprising at least one undercoat layer between the support and the reversible thermosensitive recording layer.

17. An IC card comprising:

an IC chip, and a reversible thermosensitive recording material which comprises a support in which the IC chip is provided, a reversible thermosensitive recording layer, and a gas barrier layer, the reversible thermosensitive recording layer and gas barrier layer being laid over the support, wherein the reversible thermosensitive recording layer is formed of a reversible thermosensitive composition containing a mixture of an electron-accepting compound and an electron-donating color-forming compound whose color-developed state varies depending upon at least one of a heating temperature and a cooling rate after heating, the gas barrier layer contains an inorganic layered compound and a gas barrier resin which is at least one selected from the group consisting of polyvinyl alcohol polymers and ethylene-vinyl alcohol copolymers, and the inorganic layered compound is at least one selected from the group consisting of antigorite minerals, smectite minerals and vermiculite minerals.

18. A method for producing a reversible thermosensitive recording material, comprising:

forming a reversible thermosensitive recording layer by coating a support with a reversible thermosensitive composition containing a mixture of an electron-accepting compound and an electron-donating color-forming compound whose color-developed state varies depending upon at least one of a heating temperature and a cooling rate after heating, the gas barrier layer contains an inorganic layered compound and a gas barrier resin which is at least one selected from the group consisting of polyvinyl alcohol polymers and ethylene-vinyl alcohol copolymers, and the inorganic layered compound is at least one selected from the group consisting of antigorite minerals, smectite minerals and vermiculite minerals.

19. The method according to claim 18, wherein the gas barrier resin mixed solution is prepared by dispersing the inorganic layered compound in a solution containing the gas barrier resin under a pressure of 1 MPa to 100 MPa.

* * * * *